US012228300B2

(12) United States Patent
Shin et al.

(10) Patent No.: US 12,228,300 B2
(45) Date of Patent: Feb. 18, 2025

(54) AIR CONDITIONER

(71) Applicant: LG ELECTRONICS INC., Seoul (KR)

(72) Inventors: Ilyoong Shin, Seoul (KR); Chiwoo Song, Seoul (KR); Ahrae Jo, Seoul (KR); Eunjun Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 95 days.

(21) Appl. No.: 18/112,612

(22) Filed: Feb. 22, 2023

(65) Prior Publication Data

US 2024/0068686 A1 Feb. 29, 2024

(30) Foreign Application Priority Data

Aug. 29, 2022 (KR) ..... 10-2022-0108387

(51) Int. Cl.
*F24F 11/43* (2018.01)
*F24F 1/0068* (2019.01)
(Continued)

(52) U.S. Cl.
CPC ..... *F24F 11/43* (2018.01); *F24F 1/0068* (2019.02); *F24F 5/0035* (2013.01); *F24F 11/64* (2018.01);
(Continued)

(58) Field of Classification Search
CPC .. F24F 11/43; F24F 11/64; F24F 11/84; F24F 1/0068; F24F 1/005; F24F 1/0063;
(Continued)

(56) References Cited

U.S. PATENT DOCUMENTS

2009/0095005 A1* 4/2009 Dietrich ..... B60H 1/00907 62/238.1
2009/0255284 A1* 10/2009 Yoshimi ..... F25B 45/00 62/149
(Continued)

FOREIGN PATENT DOCUMENTS

DE 11 2012 001074 12/2013
JP H06-249484 9/1994
(Continued)

OTHER PUBLICATIONS

European Search Report issued in Application No. 23157489.8 dated Aug. 25, 2023.
Korean Office Action dated Nov. 5, 2024 issued in Application No. 10-2022-0108387.

*Primary Examiner* — Joseph F Trpisovsky
(74) *Attorney, Agent, or Firm* — KED & ASSOCIATES, LLP

(57) ABSTRACT

An air conditioner may include a case through which outdoor air flows into an indoor space is formed; a first heat exchanger that exchanges heat between the air and refrigerant; a second heat exchanger disposed downstream of the first heat exchanger, through which the refrigerant selectively flows, and that exchanges heat between the air and the refrigerant; a liquid pipe connected to each of the first and second heat exchangers; a high-pressure gas pipe connected to each of the first and second heat exchangers; a low-pressure gas pipe through which the gaseous refrigerant discharged from the first and second heat exchangers flows; a high-pressure gas pipe valve; a low-pressure gas pipe valve; an expansion valve installed in the liquid pipe; and a controller configured to control an opening degree of the low-pressure gas pipe valve, based on a temperature of the refrigerant flowing through the first heat exchanger.

20 Claims, 14 Drawing Sheets

(51) Int. Cl.

| | |
|---|---|
| ***F24F 5/00*** | (2006.01) |
| ***F24F 11/64*** | (2018.01) |
| ***F24F 11/84*** | (2018.01) |
| ***F24F 13/30*** | (2006.01) |
| *F24F 1/005* | (2019.01) |
| *F24F 1/0063* | (2019.01) |
| *F24F 110/10* | (2018.01) |
| *F24F 140/20* | (2018.01) |

(52) U.S. Cl.
CPC ..... *F24F 11/84* (2018.01); *F24F 13/30* (2013.01); *F24F 1/005* (2019.02); *F24F 1/0063* (2019.02); *F24F 2110/10* (2018.01); *F24F 2140/20* (2018.01)

(58) Field of Classification Search
CPC ..... F24F 5/0035; F24F 13/30; F24F 2110/10; F24F 2140/20; F25B 2313/007; F25B 2313/0314; F25B 2700/21174; F25B 2700/21175; F25B 2600/2513; F25B 2600/2515; F25B 2600/2519; F25B 41/40; F25B 5/02; F25B 6/02
See application file for complete search history.

(56) References Cited

U.S. PATENT DOCUMENTS

| | | | | |
|---|---|---|---|---|
| 2010/0101256 | A1* | 4/2010 | Kawano | F25B 13/00 62/324.6 |
| 2015/0040594 | A1 | 2/2015 | Suzuki et al. | |
| 2016/0146478 | A1 | 5/2016 | Mantegazza | |
| 2017/0108249 | A1 | 4/2017 | Morishita | |
| 2021/0199350 | A1 | 7/2021 | Song et al. | |
| 2022/0196264 | A1 | 6/2022 | Kim et al. | |
| 2023/0074034 | A1 | 3/2023 | Shin et al. | |

FOREIGN PATENT DOCUMENTS

| | | | | |
|---|---|---|---|---|
| JP | H06-300374 | | 10/1994 | |
| JP | H07-063437 | | 3/1995 | |
| KR | 10-1782839 | | 10/2017 | |
| KR | 10-2021-0085443 | | 7/2021 | |
| KR | 10-2021-0100461 | | 8/2021 | |
| KR | 20210100461 | A * | 8/2021 | 25/5 |
| KR | 10-2022-0087159 | | 6/2022 | |
| WO | WO 2014/199317 | | 12/2014 | |

* cited by examiner

AIR CONDITIONER

CROSS-REFERENCE TO RELATED APPLICATION(S)

The present application claims priority under 35 U.S.C. 119 and 35 U.S.C. 365 to Korean Patent Application No. 10-2022-0108387, filed in Korea on Aug. 29, 2022, which is hereby incorporated by reference in its entirety.

BACKGROUND

1. Field

An air conditioner is disclosed herein.

2. Background

In the case of a ventilation device, a temperature of air supplied to a room may be adjusted through heat exchange between indoor air discharged outdoors and outdoor air supplied to the room, or an additional heater may be installed to heat the air introduced into the room. Accordingly, in a cooling mode, air introduced from the outside is cooled/dehumidified, and then the cooled and dehumidified air may be supplied to the indoor space.

In this regard, Korean Patent No. 10-1782839 (hereinafter, "Patent Document 1"), which is hereby incorporated by reference, discloses a structure for reheating air introduced into a room using a heater. However, in the case of Patent Document 1, as a temperature of flowing air is adjusted using a heater that consumes additional power, there is a problem in that energy efficiency is lowered as a lot of power is consumed. In addition, in the case of an outside air introduction conditioning system that performs dehumidification, cooling, and heating by introducing outside air, a frequency of a compressor may increase to provide sufficient dehumidification performance. However, in this case, a temperature of a surface of a dehumidification coil is lowered, causing freezing in the dehumidification coil, and as a result, there is a problem in that an air volume is reduced and a heat exchange performance is deteriorated.

In order to solve this freezing problem, in the related art, a method for heat exchange with a preheating coil is being studied in which high-temperature refrigerant flows to the dehumidification coil, refrigerant introduced into the dehumidification coil exchanges heat with the high-temperature refrigerant discharged from the condenser, or air passing through the dehumidification coil exchanges heat with the preheating coil through which hot water flows. However, conventional freeze prevention technology has a problem in that the configuration of the air conditioning system is complicated, so that product cost and maintenance costs increase. In addition, as a separate operation is performed to eliminate freezing, it is difficult to secure sufficient dehumidifying performance and the continuous operation time is shortened.

BRIEF DESCRIPTION OF THE DRAWINGS

Embodiments will be described in detail with reference to the following drawings in which like reference numerals refer to like elements, and wherein.

DETAILED DESCRIPTION

Reference will now be made to embodiments, examples of which are illustrated in the accompanying drawings. In the following description of embodiments, reference is made to the accompanying drawings that form a part hereof, and in which is shown by way of illustration specific embodiments. These embodiments are described in sufficient detail to enable those skilled in the art to practice the embodiments, and it is understood that other embodiments may be utilized and that logical structural, mechanical, electrical, and chemical changes may be made without departing from the spirit or scope. To avoid detail not necessary to enable those skilled in the art, description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Hereinafter, embodiments will be described with reference to the drawings for explaining an air conditioner according to embodiments.

Figure 1:
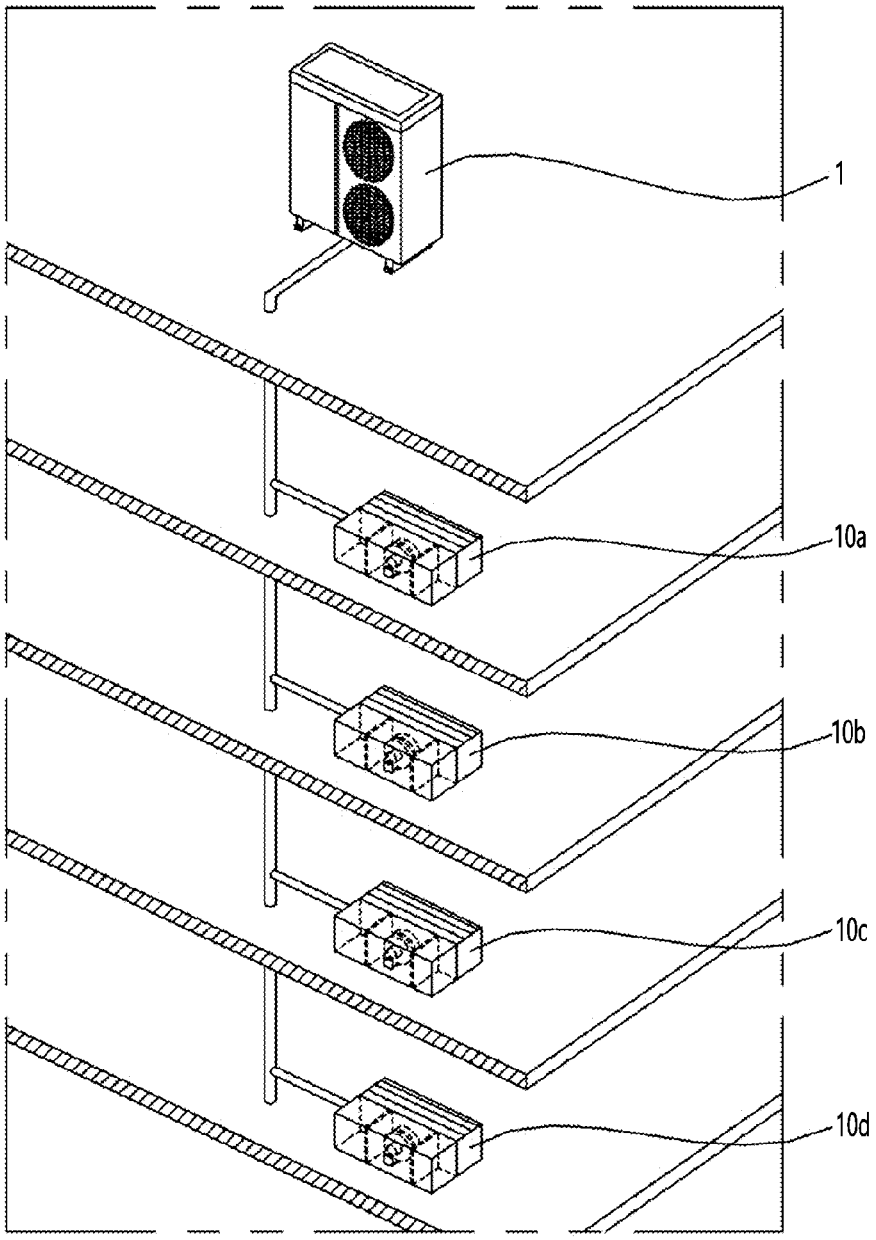
FIG. 1 is a schematic diagram illustrating an outdoor unit and a plurality of indoor units disposed in a building according to an embodiment.
Figure 2:
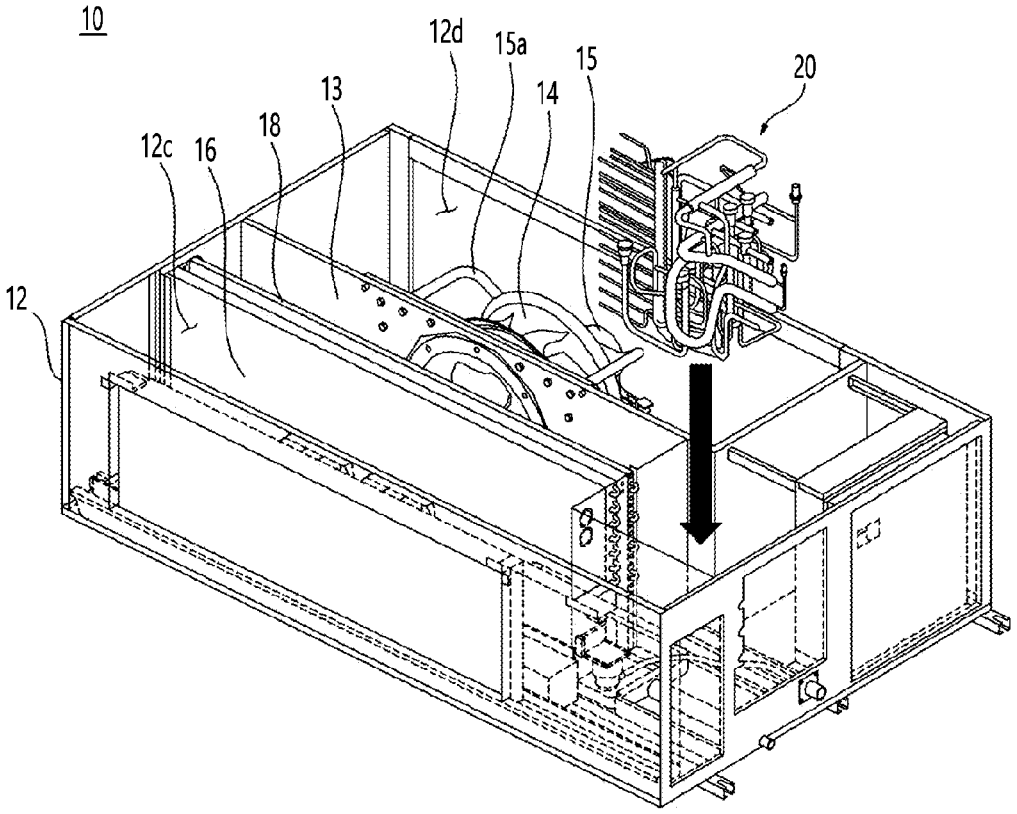
FIG. 2 is a perspective view of an internal configuration of the indoor unit of FIG. 2.
Figure 3:
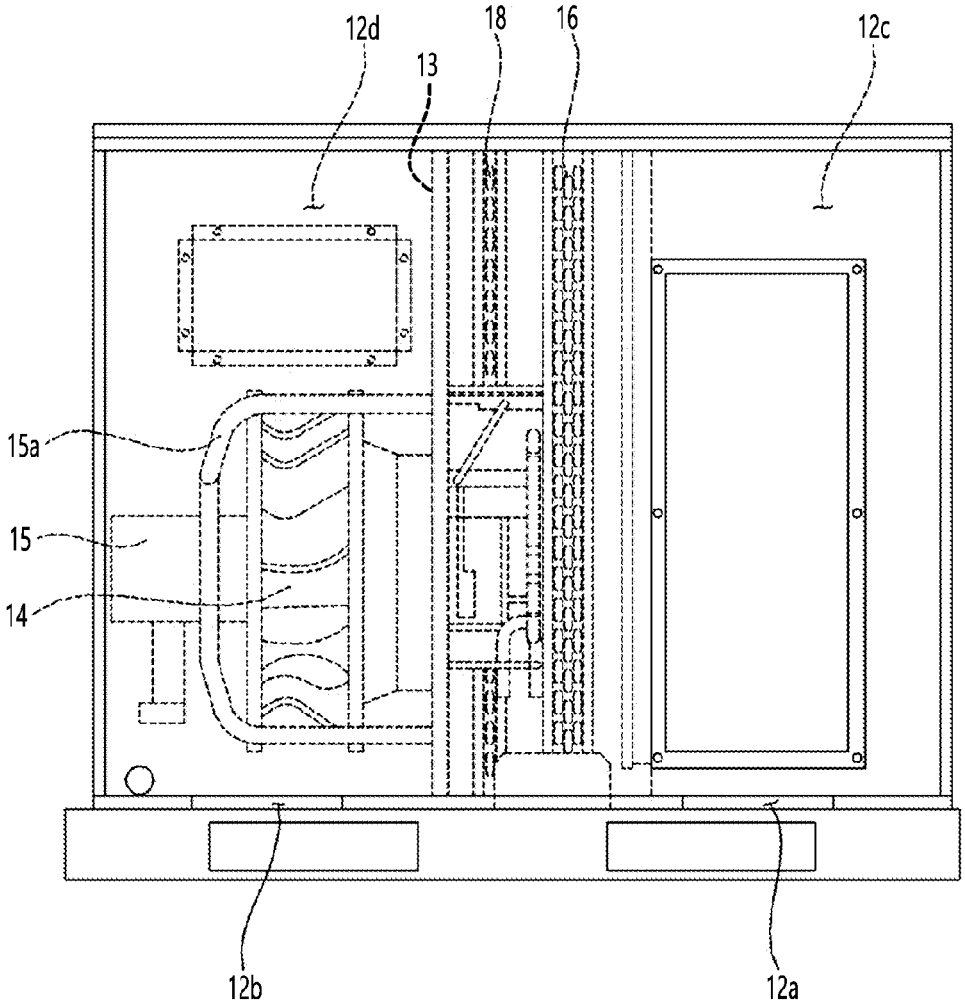
FIG. 3 is a side view of an internal configuration of an indoor unit according to an embodiment.
Figure 4:
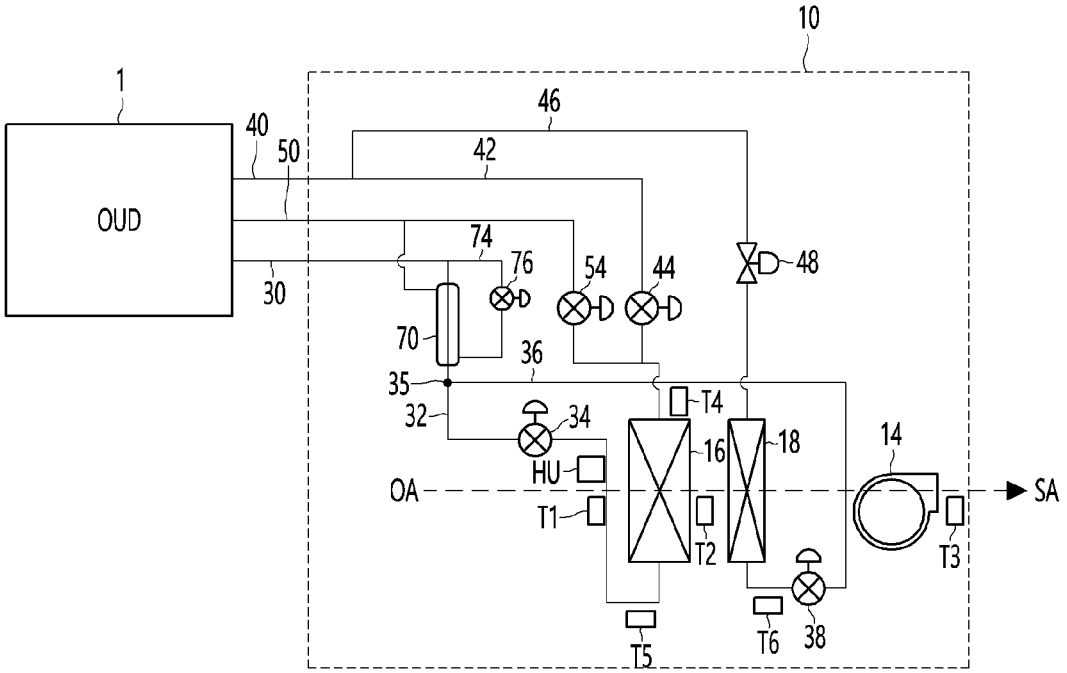
FIG. 4 is a piping diagram of an indoor unit according to an embodiment.

FIG. 1 is a schematic diagram of an outdoor unit and a plurality of indoor units disposed in a building according to an embodiment. FIG. 2 is a perspective view of an internal configuration of an indoor unit according to an embodiment. FIG. 3 is a side view for of an internal configuration of the indoor unit of FIG. 2, and FIG. 4 is a piping diagram of an indoor unit according to an embodiment.

Referring to FIG. 1, an air conditioner according to an embodiment may include an outdoor unit 1 disposed in an external space of a building, for example, and indoor units 10*a*, 10*b*, 10*c*, and 10*d* disposed in an indoor space of a building, for example. The air conditioner may include at least one outdoor unit 1 and a plurality of indoor units 10*a*, 10*b*, 10*c*, and 10*d* (10).

The outdoor unit 1 and the indoor units 10*a*, 10*b*, 10*c*, and 10*d* may be connected to each other through a plurality of refrigerant pipes. The outdoor unit 1 may be connected to the indoor unit through three refrigerant pipes 30, 40, and 50 (refer to FIG. 4, for example). The indoor unit 10 may be a ventilation device that introduces outside air, regulates a temperature through a heat exchanger, and supplies outside air to the room.

Hereinafter, an internal configuration and flow path of the indoor unit 10 will be described with reference to FIGS. 2 to 4 through the configuration of one indoor unit 10 among a plurality of indoor units. Accordingly, one indoor unit 10 described with reference to FIGS. 2 to 4 may be equally applied to a plurality of other indoor units.

Referring to FIGS. 2 and 3, the indoor unit 10 may include a case 12 that forms an external shape and forms a space in which air flows, a blowing fan 14 disposed inside of the case 12 and forming a flow of air, a first heat exchanger 16 disposed in a space formed inside of the case 12 and that exchanges heat between refrigerant and air, a second heat exchanger 18 disposed in a space formed inside of the case 12 and that exchanges heat between the refrigerant and air, and a refrigerant distributor 20 connected to a plurality of refrigerant pipes 30, 40, and 50 and sends the refrigerant introduced from the outdoor unit 1 to the first heat exchanger 16 or the second heat exchanger 18.

The first heat exchanger 16 may be referred to as a "main coil" or a "dehumidification coil". The second heat exchanger 18 may be referred to as a "sub coil" or a "reheat coil".

The case 12 may include a suction port 12*a* and a discharge port 12*b* formed on one or a first side thereof. In an inside of the case 12, supply flow paths 12*c* and 12*d* through which air introduced from a room flows may be formed. The supply flow paths 12*c* and 12*d* may include exhaust chamber 12*d* through which air inside of the case 12 is discharged to the outside and suction chamber 12*c* through which outside air is introduced into the inside of the case 12.

In addition, a partition wall 13 may be formed inside of the case 12 to partition the suction chamber 12*c* and the discharge chamber 12*d*. A communication hole may be formed in the partition wall 13 to allow air from the suction chamber 12*c* to introduce into the discharge chamber 12*d*.

The first heat exchanger 16 and the second heat exchanger 18 may be disposed in the supply flow paths 12*c* and 12*d*. The second heat exchanger 18 may be disposed downstream of the first heat exchanger 16 in the supply flow paths 12*c* and 12*d*. In other words, based on a flow direction of the air, the first heat exchanger 16 may be disposed first, and the second heat exchanger 18 may be disposed thereafter.

More specifically, the first heat exchanger 16 and the second heat exchanger 18 may be disposed in the suction chamber 12*c*. The first heat exchanger 16 and the second heat exchanger 18 may be disposed between the partition wall 13 and the suction port 12*a*.

The first heat exchanger 16 may be disposed adjacent to the suction port 12*a*, and the second heat exchanger 18 may be disposed adjacent to the partition wall 13. Accordingly, air introduced into the suction chamber 12*c* through the suction port 12*a* may flow through the first heat exchanger 16 and the second heat exchanger 18 to the discharge chamber 12*d*.

A flow rate of refrigerant flowing through the first heat exchanger 16 may be greater than a flow rate of refrigerant flowing through the second heat exchanger 18. In other words, a flow path area of the first heat exchanger 16 may be larger than a flow path area of the second heat exchanger 18. Accordingly, a temperature of air in the first heat exchanger 16 may be more significantly changed than in the second heat exchanger 18.

In some embodiments, as a cooling performance of the first heat exchanger 16 is greater than a heating performance of the second heat exchanger 18, air is cooled through or by the first heat exchanger 16, dehumidified through or by the second heat exchanger 18, and cooled and dehumidified air may be introduced into the room.

The blowing fan 14 and a fan motor 15 that rotates the blowing fan 14 are disposed in the discharge chamber 12*d*. A fan supporter 15*a* that supports the blowing fan 14 and the fan motor 15 may be disposed in the discharge chamber 12*d*. The blower fan 14 may be a plug fan in which a suction port is formed in a direction in which a rotational shaft extends and a discharge port is formed in a direction perpendicular to the rotational shaft.

The case 12 may form a space in which the refrigerant distributor 20 connected to the first heat exchanger 16 and the second heat exchanger 18 is disposed therein. The refrigerant distributor 20 may be disposed on one or a first side of the suction chamber 12*c*. The refrigerant distributor 20 may be disposed inside of the case 12 and connect the outdoor unit 1 with the first heat exchanger 16 and the second heat exchanger 18.

The refrigerant distributor 20 may include a plurality of refrigerant pipes and a plurality of valves. In this embodiment, the refrigerant distributor 20 will be described as being built into the indoor unit 10.

Referring to FIG. 4, the indoor unit 10 includes a plurality of refrigerant pipes 30, 40, and 50 and a plurality of valves. The plurality of refrigerant pipes 30, 40, and 50 may include liquid pipe 30 that connects the outdoor unit 1, the first heat exchanger 16, and the second heat exchanger 18 and through which liquid refrigerant flows; high-pressure gas pipe 40 that connects the outdoor unit 1, the first heat exchanger 16, and the second heat exchanger 18, and through which gaseous refrigerant flows; and low-pressure gas pipe 50 that connects the outdoor unit 1 and the first heat exchanger 16. The plurality of valves may include high-pressure gas pipe valve 44 which is disposed in the high-pressure gas pipe 40 and sends the refrigerant flowing through the high-pressure gas pipe 40 to the first heat exchanger 16 or the second heat exchanger 18; low-pressure gas pipe valve 54 disposed in the low-pressure gas pipe 50 and that opens and closes the low-pressure gas pipe 50; and expansion valves 34 and 38 disposed in the liquid pipe 30 and that open and close the liquid pipe 30.

The liquid pipe 30 may include first liquid pipe 32 connected to the first heat exchanger 16, and second liquid pipe 36 branched from a branch point 35 of the first liquid pipe 32 and connected to the second heat exchanger 18. The branch point 35 may be formed at a point between a supercooler 70 and the first expansion valve 34 described hereinafter.

First expansion valve 34 that expands refrigerant flowing into the first heat exchanger 16 may be disposed in the first liquid pipe 32. Second expansion valve 38 that expands refrigerant flowing into the second heat exchanger 18 may be disposed in the second liquid pipe 36.

The supercooler 70 may be disposed in the liquid pipe 30 to supercool the refrigerant flowing in the liquid pipe 30 by expanding and exchanging heat with a portion of the refrigerant flowing in the liquid pipe 30. An inlet side of the supercooler 70 may be connected to the liquid pipe 30, and an outlet side of the subcooler 70 may be connected to the low-pressure gas pipe 50.

A portion of the refrigerant flowing through the liquid pipe 30 flows through a branch pipe 74 branched at one point of the liquid pipe 30. The branch pipe 74 connects the liquid pipe 30 and the supercooler 70. A supercooling expansion valve 76 that decompresses the refrigerant may be disposed in the branch pipe 74.

The refrigerant flowing along the branch pipe 74 may pass through the supercooling expansion valve 76 and then through the supercooler 70. The refrigerant that has passed through the supercooler 70 may flow to the low-pressure gas pipe 50 to be combined with the refrigerant of the low-pressure gas pipe 50.

The high-pressure gas pipe 40 may include first high-pressure gas pipe 42 connected to the first heat exchanger 16 and second high-pressure gas pipe 46 branched at one point of the first high-pressure gas pipe 42 and connected to the second heat exchanger 18. First high-pressure gas pipe valve 44 that opens and closes the first high-pressure gas pipe 42 may be disposed in the first high-pressure gas pipe 42. Second high-pressure gas pipe valve 48 that opens and closes the second high-pressure gas pipe 46 may be disposed in the second high-pressure gas pipe 44.

The first high-pressure gas pipe valve 44 may include an electronic expansion valve (EEV) capable of adjusting a flow rate of the refrigerant by adjusting an opening degree. The electronic expansion valve may decrease a pressure of the refrigerant passing through the first high-pressure gas pipe valve 44 by adjusting the opening degree.

For example, when the electronic expansion valve is completely opened, the refrigerant may pass through without decompression, and when the opening degree of the electronic expansion valve decreases, the refrigerant may be decompressed. A degree of decompression of the refrigerant increases as the opening degree of the electromagnetic expansion valve decreases.

The low-pressure gas pipe 50 may be connected to the first heat exchanger 16. The low-pressure gas pipe 50 may be connected to the first high-pressure gas pipe 42. The low-pressure gas pipe valve 54 that opens and closes the low-pressure gas pipe 50 may be disposed in the low-pressure gas pipe 50. The low-pressure gas pipe valve 54 may include an electronic expansion valve (EEV) capable of adjusting the flow rate of the refrigerant by adjusting the opening degree.

In this embodiment, in order to control an indoor evaporation pressure to be higher than an outdoor evaporation pressure, flow rate coefficients of the first high-pressure gas pipe valve 44 and the low-pressure gas pipe valve 54 are configured to be larger than flow rate coefficients of the second high-pressure gas pipe valve 48; the first expansion valve 34, and the second expansion valve 38. In other words, it is possible to prevent freezing of the first heat exchanger 16 by relatively increasing an evaporation power of the first heat exchanger 16.

The indoor unit 10 may further include a humidity detection sensor HU and a plurality of temperature detection sensors T1 to T6. The humidity detection sensor HU may be understood as a sensor that measures a humidity of outdoor air. The detected humidity may be provided to the controller of the indoor unit 10 or the outdoor unit 1. Humidity detected by the humidity detection sensor HU may be defined as a "present humidity value".

The plurality of temperature detection sensors T1 to T6 may be understood as sensors that measures a temperature of air or refrigerant. The detected temperature may be provided to the controller of the indoor unit 10 or the outdoor unit 1.

More specifically, the plurality of temperature detection sensors may include first temperature detection sensor T1 to sixth temperature detection sensor T6. The first temperature detection sensor T1 may measure a temperature of outdoor air. The first temperature detection sensor T1 may measure the temperature of the outdoor air before the outdoor air passes through the first heat exchanger 16. The temperature detected by the first temperature detection sensor T1 may be defined as a "first temperature value" or "heat exchanger air inlet temperature". The second temperature detection sensor T2 may measure a temperature of the outdoor air after the outdoor air has passed through the first heat exchanger 16. The temperature detected by the second temperature detection sensor T2 may be defined as a "second temperature value" or a "heat exchanger air outlet temperature". The first temperature detection sensor T1 and the second temperature detection sensor T2 may be installed around the first heat exchanger 16.

The third temperature detection sensor T3 may measure a temperature of the outdoor air after the outdoor air has passed through the first heat exchanger 16 and the second heat exchanger 18. The third temperature detection sensor T3 may measure a temperature of the air discharged from the blowing fan 14 of the indoor unit 10. The third temperature detection sensor T3 may be installed on an air outlet side of the blowing fan 14. The temperature detected by the third temperature detection sensor T3 may be defined as a "third temperature value" or "air discharge temperature".

The fourth temperature detection sensor T4 may measure a refrigerant temperature at an inlet side of the first heat exchanger 16. For example, the fourth temperature detection sensor T4 may be installed on an inlet side of a pipe of the first heat exchanger 16. The temperature detected by the fourth temperature detection sensor T4 may be defined as a "fourth temperature value" or a "heat exchanger inlet side refrigerant temperature".

The fifth temperature detection sensor T5 may measure a refrigerant temperature at an outlet side of the first heat exchanger 16. For example, the fifth temperature detection sensor T5 may be installed at an outlet side of a pipe of the first heat exchanger 16. The temperature detected by the fifth temperature detection sensor T5 may be defined as a "fifth temperature value" or a "heat exchanger outlet side refrigerant temperature".

The sixth temperature detection sensor T6 may measure a refrigerant temperature at an outlet side of the second heat exchanger 18. For example, the sixth temperature detection sensor T6 may be installed at an outlet side of the second heat exchanger 18. The temperature detected by the sixth temperature detection sensor T6 may be defined as a "sixth temperature value".

As described above, in the air conditioner according to embodiments, one outdoor unit 1 is connected to a plurality of indoor units 10. The air conditioner according to embodiments may be operated in a heating mode M1 in which only a portion of the plurality of indoor units 10 is used for heating, a cooling mode M2 in which only a portion of the plurality of indoor units 10 is used for cooling, a cooling/dehumidifying mode (individual cooling mode) M3, in which some of the plurality of indoor units 10 is used for cooling and the rest is used for heating, and a defrost mode M4 used for defrosting the outdoor heat exchanger while operating in heating mode.

Figure 5:
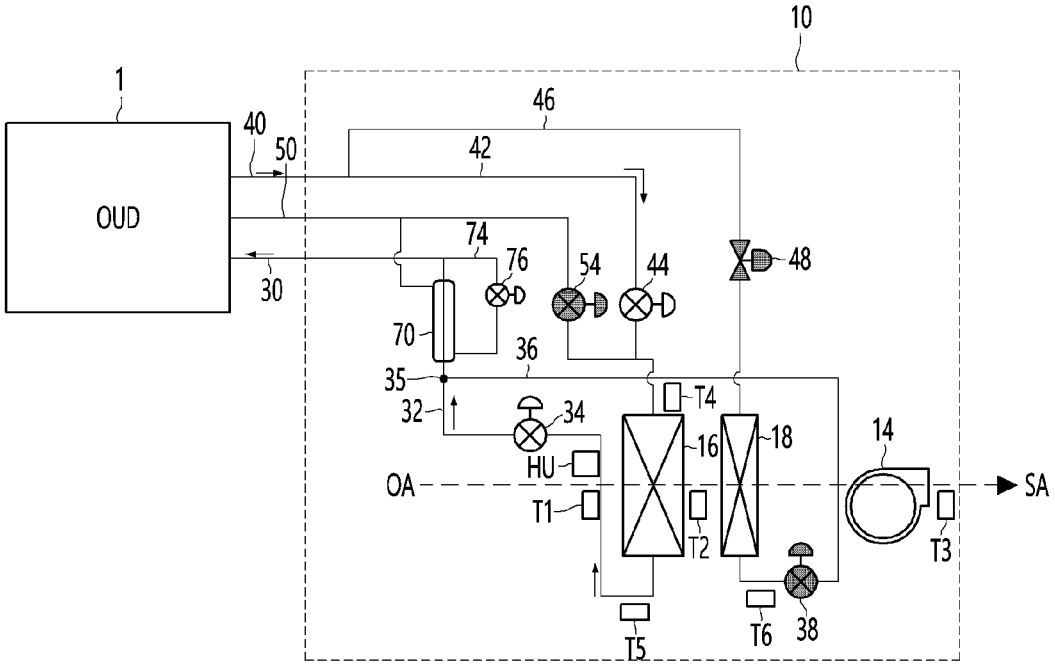
FIG. 5 is a piping diagram for explaining refrigerant flow in a heating mode of an indoor unit according to an embodiment.

FIG. 5 is a piping diagram for explaining refrigerant flow in a heating mode of an indoor unit according to an embodiment. Hereinafter, the heating mode M1 will be described with reference to FIG. 5.

In the heating mode M1, only the liquid pipe 30 and the high-pressure gas pipe 40 are used, and the refrigerant may not flow into the low-pressure gas pipe 50. In the heating mode M1, the refrigerant is introduced into the indoor unit 10 from the outdoor unit 1 through the high-pressure gas pipe 40, and the refrigerant of the indoor unit 10 flows into the outdoor unit 1 through the liquid pipe 30.

At this time, the first high-pressure gas pipe valve 44, the first expansion valve 34, and the supercooling expansion valve 76 are opened, and the second high-pressure gas pipe valve 48, the second expansion valve 38, and the low-pressure gas pipe valve 54 are closed. The outdoor heat exchanger of the outdoor unit 1 functions as an evaporator, and the first heat exchanger 16 functions as a condenser. In addition, the refrigerant does not flow to the second heat exchanger 18.

When the air conditioner is operated in the heating mode M1, high-temperature and high-pressure refrigerant compressed by the compressor of the outdoor unit 1 is introduced into the indoor unit 10 through the first high-pressure gas pipe 42. In addition, the refrigerant of the first high-pressure gas pipe 42 passes through the first high-pressure gas pipe valve 44 and is introduced into the first heat exchanger 16 to be condensed. At this time, the first high-pressure gas pipe valve 44 may be in a fully open state.

The condensed refrigerant discharged from the first heat exchanger 16 passes through the first liquid pipe 32 and the first expansion valve 34 and then is introduced into the supercooler 70. In this case, the first expansion valve 34 may be in a partially opened state.

Some of the refrigerant introduced into the supercooler 70 passes through the supercooling expansion valve 76 to supercool the refrigerant flowing in the liquid pipe 30, and the remaining portion thereof is introduced into the outdoor unit 1 through the first liquid pipe 32. The refrigerant introduced into the outdoor unit 1 evaporates in the outdoor heat exchanger and then is recovered to the compressor.

Figure 6:
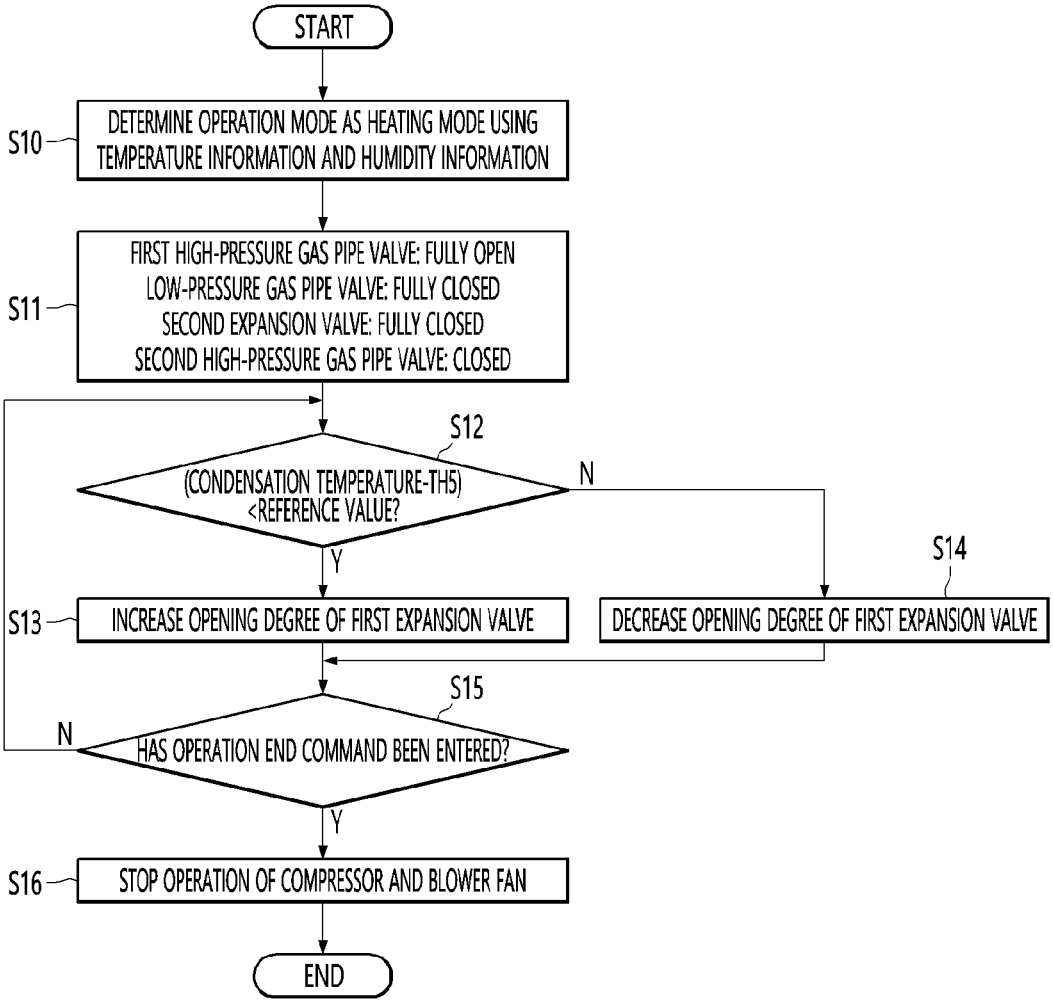
FIG. 6 is a flowchart of a method for controlling an air conditioner in a heating mode of an indoor unit according to an embodiment.

FIG. 6 is a flowchart of a method for controlling an air conditioner in a heating mode of an indoor unit according to an embodiment. Referring to FIG. 6, the air conditioner determines an operation mode as a heating mode using temperature information and humidity information. The temperature information may include a present temperature value of the outdoor air detected by the first temperature detection sensor T1 and a set or predetermined temperature value input by a user.

The humidity information may include a present humidity value of outdoor air detected by the humidity detection sensor HU, and a set or predetermined humidity value input by a user. For example, when the set temperature value input by the user is higher than the present temperature value of the outdoor air, the air conditioner may be operated in the heating mode M1 (S10).

When operating in the heating mode M1, the first high-pressure gas pipe valve 44 is fully opened, and the low-pressure gas pipe valve 54, the second expansion valve 38, and the second high-pressure gas pipe valve 48 are closed (S11). Accordingly, the first heat exchanger 16 functions as a condenser, and the outdoor heat exchanger of the outdoor unit 1 functions as an evaporator. The second heat exchanger 18 is not used.

The air conditioner may control the opening degree of the first expansion valve 34 to achieve an appropriate level of heating. The air conditioner may determine whether the present heating level of the indoor unit is a target level (set or predetermined level). That is, the air conditioner determines whether the difference between a condensation temperature and the fifth temperature value is smaller than a reference value (S12). The condensation temperature means an outdoor condensation temperature detected by a sensor provided in the outdoor unit 1, and the fifth temperature value means a temperature detected by the fifth temperature detection sensor T5, and a reference value means a preset or predetermined temperature value.

When the difference between the condensation temperature and the fifth temperature value is smaller than the reference value, the air conditioner determines that the present heating level of the indoor unit is less than the target level, and increases the opening degree of the first expansion valve 34 (S13). When the opening degree of the first expansion valve 34 increases, the flow rate of the refrigerant passing through the first expansion valve 34 further increases, so that the present heating level of the indoor unit may increase close to the target level.

In contrast, when the difference between the condensation temperature and the fifth temperature value is greater than the reference value, the air conditioner determines that the present heating level of the indoor unit exceeds the target level, and thus, reduces the opening degree of the first expansion valve 34 (S14). When the opening degree of the first expansion valve 34 decreases, the flow rate of the refrigerant passing through the first expansion valve 34 relatively decreases, so that the present heating level of the indoor unit may decrease close to the target level.

The air conditioner determines whether an operation end command is input through an input portion, stops operation of the compressor and the blower fan 14 when the operation end command is input, and when the operation end command is not input, returns to S12 (S15 and S16).

Figure 7:
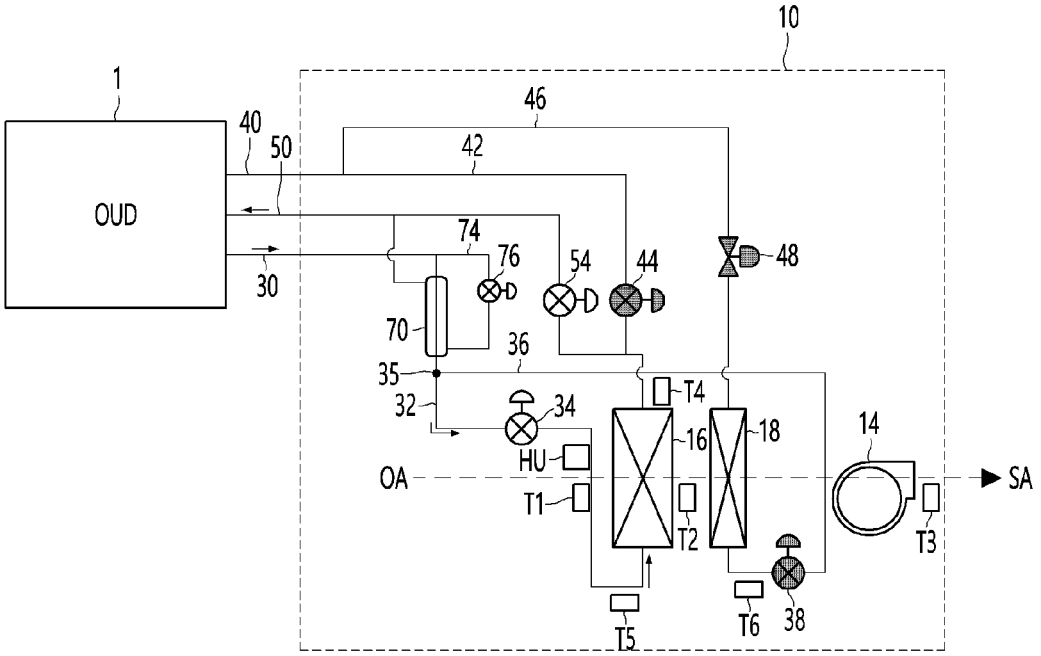
FIG. 7 is a piping diagram for explaining refrigerant flow in a cooling mode of an indoor unit according to an embodiment.

FIG. 7 is a piping diagram for explaining refrigerant flow in a cooling mode of an indoor unit according to an embodiment. Hereinafter, the cooling mode M2 will be described with reference to FIG. 7.

In the cooling mode M2, only the liquid pipe 30 and the low-pressure gas pipe 50 are used, and the refrigerant may not flow into the high-pressure gas pipe 40. In the cooling mode M2, the refrigerant is introduced into the indoor unit 10 from the outdoor unit 1 through the liquid pipe 30, and the refrigerant of the indoor unit 10 is introduced into the outdoor unit 1 through the low-pressure gas pipe 50.

At this time, the low-pressure gas pipe valve 54, the first expansion valve 34, and the supercooling expansion valve 76 are opened, and the first high-pressure gas pipe valve 44, the second high-pressure gas pipe valve 48, and the second expansion valve 38 are closed. The outdoor heat exchanger of the outdoor unit 1 functions as a condenser, and the first heat exchanger 16 functions as an evaporator. In addition, the refrigerant does not flow to the second heat exchanger 18.

When the air conditioner is operated in the cooling mode M2, high-temperature and high-pressure refrigerant compressed by the compressor of the outdoor unit 1 is condensed in the outdoor heat exchanger of the outdoor unit 1 and then is introduced into the indoor unit 10 through the liquid pipe 30. A (first) portion of the refrigerant in the liquid pipe 30 is introduced into the supercooling expansion valve 76 through the branch pipe 74, and the remaining (second) portion of the refrigerant is introduced into the first expansion valve 34 through the first liquid pipe 32.

The refrigerant that has passed through the first expansion valve 34 is decompressed and then is introduced into the first heat exchanger 16 and evaporates. The refrigerant discharged from the first heat exchanger 16 passes through the low-pressure gas pipe valve 54 along the low-pressure gas pipe 50. At this time, the low-pressure gas pipe valve 54 may be in a fully open state or a partially open state. The refrigerant that has passed through the low-pressure gas pipe valve 54 is introduced into the compressor of the outdoor unit 1 along the low-pressure gas pipe 50.

Figure 8:
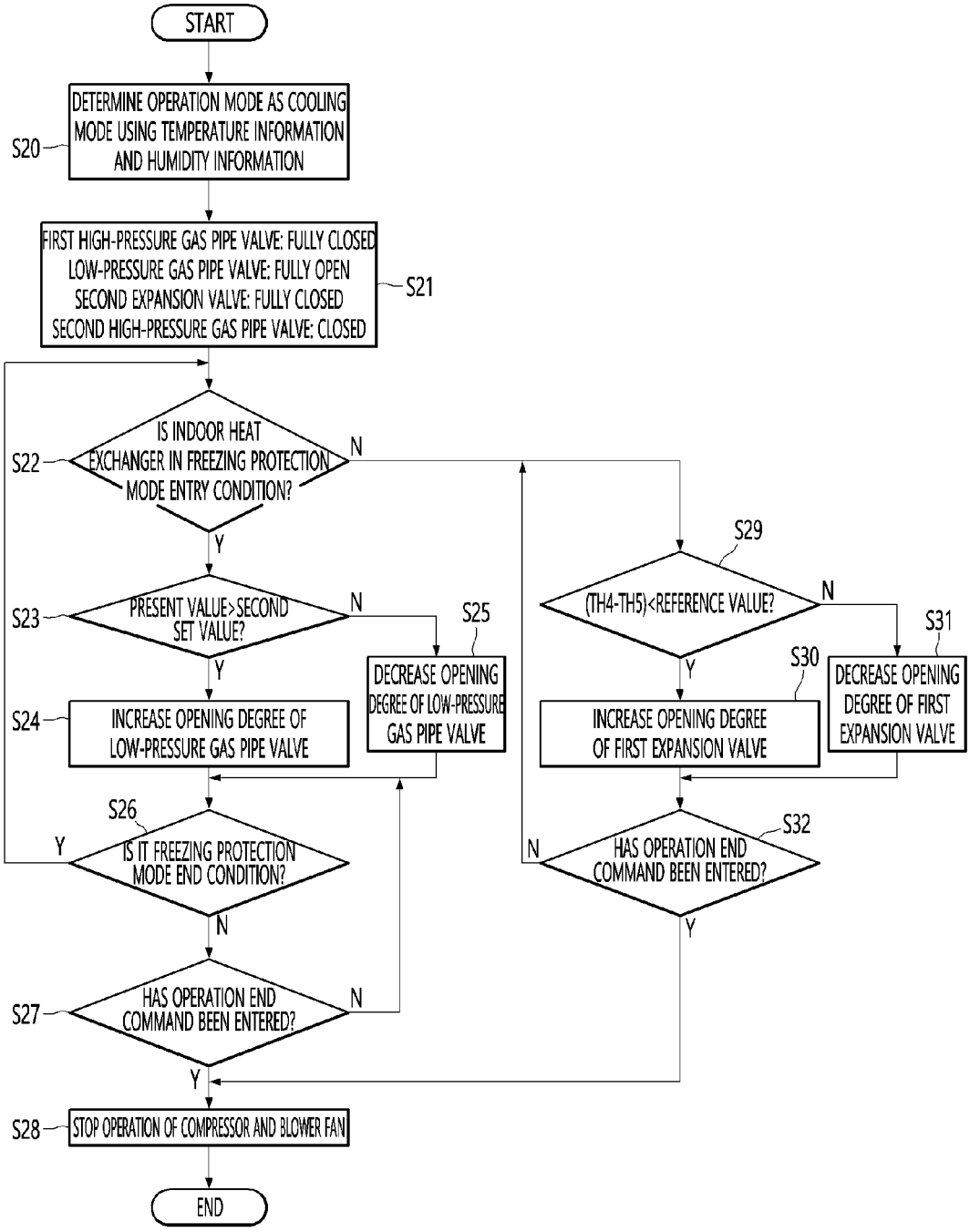
FIG. 8 is a flowchart of a method for controlling an air conditioner in a cooling mode of an indoor unit according to an embodiment.

FIG. 8 is a flowchart of a method for controlling an air conditioner in a cooling mode of an indoor unit according to an embodiment. Referring to FIG. 8, the air conditioner determines an operation mode as a cooling mode using temperature information and humidity information.

The temperature information may include a present temperature value of the outdoor air detected by the first temperature detection sensor T1 and a set or predetermined temperature value input by a user. The humidity information may include a present humidity value of outdoor air detected by the humidity detection sensor HU, and a set or predetermined humidity value input by a user. For example, when the set temperature value input by the user is lower than the present temperature value of the outdoor air and the set humidity value input by the user is higher than the present humidity value of the outdoor air, the air conditioner may be driven in the cooling mode M2 (S20).

When operating in the cooling mode M2, the first high-pressure gas pipe valve 44 is closed, the low-pressure gas pipe valve 54 is opened, and the second expansion valve 38 and the second high-pressure gas pipe valve 48 are closed (S21). Accordingly, the outdoor heat exchanger of the outdoor unit 1 functions as a condenser, and the first heat exchanger 16 functions as an evaporator. The second heat exchanger 18 is not used.

The air conditioner may prevent the indoor heat exchanger (dehumidification coil) from freezing by controlling the opening degree of the low-pressure gas pipe valve 54. That is, the air conditioner determines whether the indoor heat exchanger is in a freezing protection mode entry condition (S22).

More specifically, the freezing protection mode entry condition may include a case in which an inlet-side refrigerant temperature of the first heat exchanger 16 is less than a first set or predetermined value, or an outlet-side refrigerant temperature of the first heat exchanger 16 is less than the first set or predetermined value, or a temperature of air passing through the first heat exchanger 16 is less than the first set or predetermined value. The first set or predetermined value may be a preset temperature, and may be set by a user. In other words, when the first temperature value, the second temperature value, the fourth temperature value, or the fifth temperature value is lower than the first set value, the air conditioner may enter the freezing protection mode.

When the freezing protection mode is entered, the air conditioner determines whether the present value is greater than a second set value (S23). The present value may be a temperature detected by the fourth temperature detection sensor T4 or a temperature detected by the fifth temperature detection sensor T5. Alternatively, the present value may be an average value of the fourth temperature value and the fifth temperature value.

The second set value means a preset or predetermined temperature value. The second set value may be a lower temperature than the first set value. When the present value is greater than the second set value, the air conditioner determines that a possibility of freezing of the indoor heat exchanger is small, and increases or maintains the opening degree of the low-pressure gas pipe valve 54 (S24).

When the opening degree of the low-pressure gas pipe valve 54 is increased, the flow rate of the refrigerant passing through the low-pressure gas pipe valve 54 increases, so that a cooling capacity of the indoor heat exchanger may be improved. In contrast, when the present value is smaller than the second set value, the air conditioner determines that the possibility of freezing of the indoor heat exchanger is high, and thus, reduces the opening degree of the low-pressure gas pipe valve 54 (S25).

When the opening degree of the low-pressure gas pipe valve 54 is decreased, a pressure of the refrigerant passing through the low-pressure gas pipe valve 54 increases. In this case, the flow rate coefficient of the low-pressure gas pipe valve 54 may be greater than the flow rate coefficient of the first expansion valve 34 and the outdoor expansion valve of the outdoor unit 1. Accordingly, as an evaporation pressure (indoor evaporation pressure) of the indoor heat exchanger is controlled to be higher than an evaporation pressure (outdoor evaporation pressure) of the outdoor heat exchanger, freezing of the indoor heat exchanger may be prevented.

Thereafter, the air conditioner determines whether the freezing protection mode end condition is met (S26). If the freezing protection mode end condition is met, the air conditioner goes to S22, and if the freezing protection mode end condition is not met, the air conditioner determines whether an operation end command is input (S27).

More specifically, the freezing protection mode end condition may include cases in which the inlet-side refrigerant temperature of the first heat exchanger 16 is a third set or predetermined value or more, or the outlet-side refrigerant temperature of the first heat exchanger 16 is the third set value or more. The third set value may be a temperature higher than the first set value and the second set value. In other words, when the fourth temperature value or the fifth temperature value is higher than the third set value, the air conditioner may end the freezing protection mode.

The air conditioner stops operation of the compressor and the blower fan 14 when an operation end command is input (S28), and goes to S26 when the operation end command is not input.

When the air conditioner does not meet the freezing protection mode entry condition, it is possible to control the opening degree of the first expansion valve 34 to achieve an appropriate level of cooling. The air conditioner may determine whether the present cooling level of the indoor unit is a target level (set level). That is, the air conditioner determines whether a difference between the fourth temperature value TH4 and the fifth temperature value TH5 is smaller than a reference value (S29). The fourth temperature value TH4 means the temperature detected by the fourth temperature detection sensor T4, and the fifth temperature value TH5 means the temperature detected by the fifth temperature detection sensor T5, and the reference value means a preset or predetermined temperature value.

When the difference between the fourth temperature value and the fifth temperature value is smaller than the reference value, the air conditioner determines that the present cooling level of the indoor unit is less than the target level and increases the opening degree of the first expansion valve 34

(S30). When the opening degree of the first expansion valve 34 is increased, the flow rate of the refrigerant passing through the first expansion valve 34 further increases, so that the present cooling level of the indoor unit may increase close to the target level.

In contrast, when the difference between the fourth temperature value and the fifth temperature value is greater than the reference value, the air conditioner determines that the present cooling level of the indoor unit exceeds the target level, and thus, reduces the opening degree of the first expansion valve 34 (S31). When the opening degree of the first expansion valve 34 is decreased, the flow rate of the refrigerant passing through the first expansion valve 34 relatively decreases, so that the present cooling level of the indoor unit may decrease close to the target level.

Thereafter, the air conditioner determines whether an operation end command is input (S32), stops operation of the compressor and the blower fan 14 when the operation end command is input (S28), and proceeds to S29 when the operation end command is not input.

According to the cooling mode M2 as described above, when the cooling mode is operated for a long time, it is possible to prevent the indoor heat exchanger (dehumidification coil) from freezing. In other words, in the cooling mode M2, the indoor heat exchanger may be prevented from freezing by adjusting the opening degree of the low-pressure gas pipe valve 54 to control the indoor evaporation pressure to be higher than the outdoor evaporation pressure.

Figure 9:
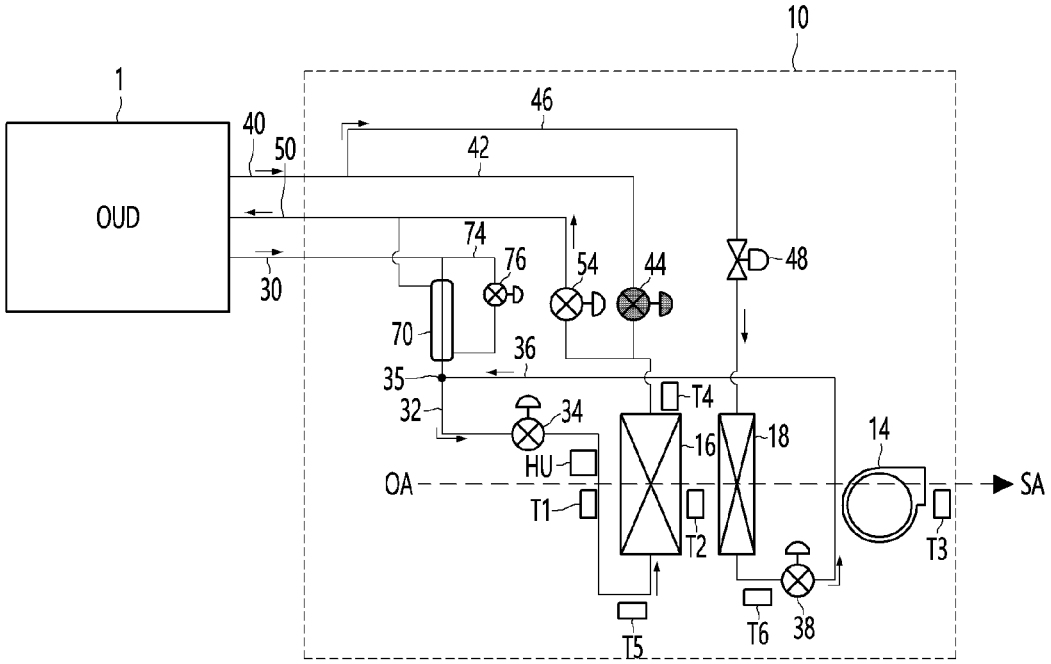
FIGS. 9 and 10 are piping diagrams for explaining refrigerant flow in a cooling/dehumidifying mode of an indoor unit according to an embodiment.
Figure 10:
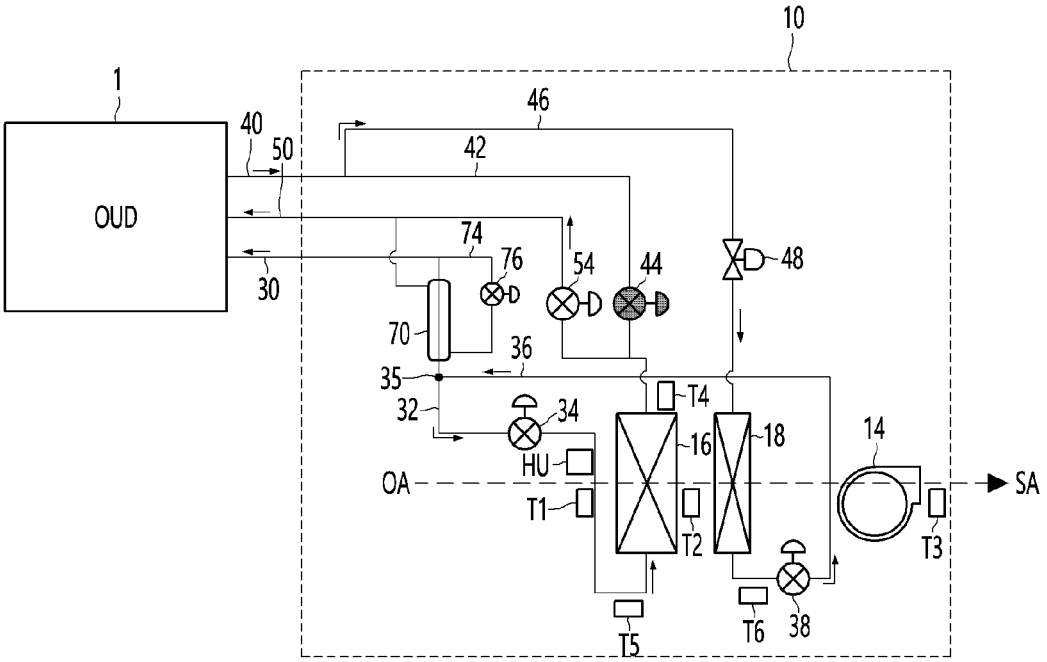

FIGS. 9 and 10 are piping diagrams for explaining refrigerant flow in a cooling/dehumidifying mode of an indoor unit according to an embodiment. In this embodiment, the cooling/dehumidifying mode M3 includes first cooling/dehumidifying mode M3-1 in which the outdoor heat exchanger of the outdoor unit 10 is used as a condenser, some or a first of the plurality of indoor units 10 is used as an evaporator, and the other or a second portion of the plurality of indoor units 10 is used as a condenser, and second cooling/dehumidifying mode M3-2 in which an outdoor heat exchanger is used as an evaporator and some or a first of the plurality of indoor units 10 is used as an evaporator and the other or a second portion of the plurality of indoor units 10 is used as a condenser. The cooling/dehumidifying mode may be referred to as a "reheating and dehumidifying mode".

Hereinafter, the first cooling/dehumidifying mode M3-1 will be described with reference to FIG. 9. In the first cooling/dehumidifying mode M3-1, the refrigerant flows from the outdoor unit 1 into the indoor unit 10 through the high-pressure gas pipe 40 and the liquid pipe 30, and through the low-pressure gas pipe 50, the refrigerant of the indoor unit 10 flows to the outdoor unit 1.

At this time, the low-pressure gas pipe valve 54, the second high-pressure gas pipe valve 48, the first expansion valve 34, the second expansion valve 38, and the supercooling expansion valve 76 are opened, and the first high-pressure gas pipe valve 44 is closed. The outdoor heat exchanger of the outdoor unit 1 functions as a condenser, and the first heat exchanger 16 functions as an evaporator. The second heat exchanger 18 functions as a condenser and can heat the air that has passed through the second heat exchanger 18.

First, a flow of the refrigerant will be described with reference to the first heat exchanger 16.

When the air conditioner is operated in the first cooling/dehumidifying mode M3-1, some of the high-temperature and high-pressure refrigerant compressed by the compressor of the outdoor unit 1 is condensed in the outdoor heat exchanger of the outdoor unit 1 and then is introduced into the indoor unit 10 through the liquid pipe 30. In addition, a (first) portion of the refrigerant in the liquid pipe 30 is introduced into the supercooling expansion valve 76 through the branch pipe 74, and the remaining (second) portion of the refrigerant is introduced into the first expansion valve 34 through the first liquid pipe 32.

The refrigerant that has passed through the first expansion valve 34 is decompressed and then is introduced into the first heat exchanger 16 and evaporates. The refrigerant discharged from the first heat exchanger 16 passes through the low-pressure gas pipe valve 54 along the low-pressure gas pipe 50. At this time, the low-pressure gas pipe valve 54 may be in a fully open state or a partially open state.

The refrigerant that has passed through the low-pressure gas pipe valve 54 is introduced into the compressor of the outdoor unit 1 along the low-pressure gas pipe 50. In this embodiment, by adjusting the opening degree of the low-pressure gas pipe valve 54, it is possible to prevent frost from forming on a surface of the first heat exchanger 16.

Next, the flow of the refrigerant will be described with reference to the second heat exchanger 18.

When the air conditioner is operated in the cooling/dehumidifying mode M3-1, the remaining portion of the high-temperature and high-pressure refrigerant compressed by the compressor of the outdoor unit 1 is introduced into the indoor unit 10 through the second high-pressure gas pipe 46. In addition, the refrigerant of the second high-pressure gas pipe 46 passes through the second high-pressure gas pipe valve 48 and is introduced into the second heat exchanger 18 to be condensed.

The condensed refrigerant discharged from the second heat exchanger 18 passes through the second liquid pipe 36 and the second expansion valve 38 and then is introduced into the branch point 35 of the liquid pipe 30. The refrigerant introduced into the branch point 35 joins the refrigerant flowing through the first liquid pipe 32 and is decompressed at the first expansion valve 34 and then is introduced into the first heat exchanger 16 and evaporates.

Hereinafter, the second cooling/dehumidifying mode M3-2 will be described with reference to FIG. 10. In the second cooling/dehumidifying mode M3-2, the refrigerant flows from the outdoor unit 1 to the indoor unit 10 through the high-pressure gas pipe 40, and the refrigerant of the indoor unit 10 flows to the outdoor unit 1 through the liquid pipe 30 and the low-pressure gas pipe 50. At this time, the low-pressure gas pipe valve 54, the second high-pressure gas pipe valve 48, the first expansion valve 34, the second expansion valve 38, and the supercooling expansion valve 76 are opened, and the first high-pressure gas pipe valve 44 is closed.

The outdoor heat exchanger of the outdoor unit 1 and the first heat exchanger 16 function as an evaporator. The second heat exchanger 18 functions as a condenser, and can heat the air that has passed through the second heat exchanger 18.

When the air conditioner is operated in the second cooling/dehumidifying mode (M3-2), high-temperature and high-pressure refrigerant compressed in the compressor of the outdoor unit 1 is introduced into the indoor unit 10 through the second high-pressure gas pipe 46. In addition, the refrigerant of the second high-pressure gas pipe 46 passes through the second high-pressure gas pipe valve 48 and is introduced into the second heat exchanger 18 to be condensed.

The condensed refrigerant discharged from the second heat exchanger 18 passes through the second liquid pipe 36 and the second expansion valve 38 and then is introduced into the branch point 35 of the liquid pipe 30. Some of the refrigerant introduced into the branch point 35 flows into the first liquid pipe 32, is decompressed by the first expansion valve 34, and then evaporates in the first heat exchanger 16. The evaporated refrigerant is introduced into the compressor of the outdoor unit 1 through the low-pressure gas pipe 50 and the first low-pressure gas pipe valve 54. At this time, the low-pressure gas pipe valve 54 may be in a fully open state or a partially open state. In this embodiment, by adjusting the opening degree of the low-pressure gas pipe valve 54, it is possible to prevent frost from forming on the surface of the first heat exchanger 16.

The remaining portion of the refrigerant introduced into the branch point 35 is introduced into the supercooler 70 through the liquid pipe 30. Some of the refrigerant introduced into the supercooler 70 supercools the refrigerant flowing through the liquid pipe 30 through the supercooling expansion valve 76 and then joins the low-pressure gas pipe 50 to be introduced into the outdoor unit 1.

The remaining portion of the refrigerant introduced into the supercooler 70 is introduced into the outdoor unit 1 through the first liquid pipe 32. The refrigerant introduced into the outdoor unit 1 passes through the outdoor expansion device of the outdoor unit 1 and is decompressed, and then evaporates in the outdoor heat exchanger of the outdoor unit 1. The evaporated refrigerant is recovered to the compressor of the outdoor unit 1.

In the cooling/dehumidifying mode M3-1 and M3-2 as described above, air cooled by passing through the first heat exchanger 16 and having a low humidity is partially heated while passing through the second heat exchanger 18 and then may be introduced into the room in a state in which the relative humidity is lowered. Accordingly, the air that has passed through the first heat exchanger 16 and the second heat exchanger 18 may be introduced into the room in a cooled and dehumidified state.

Figure 11:
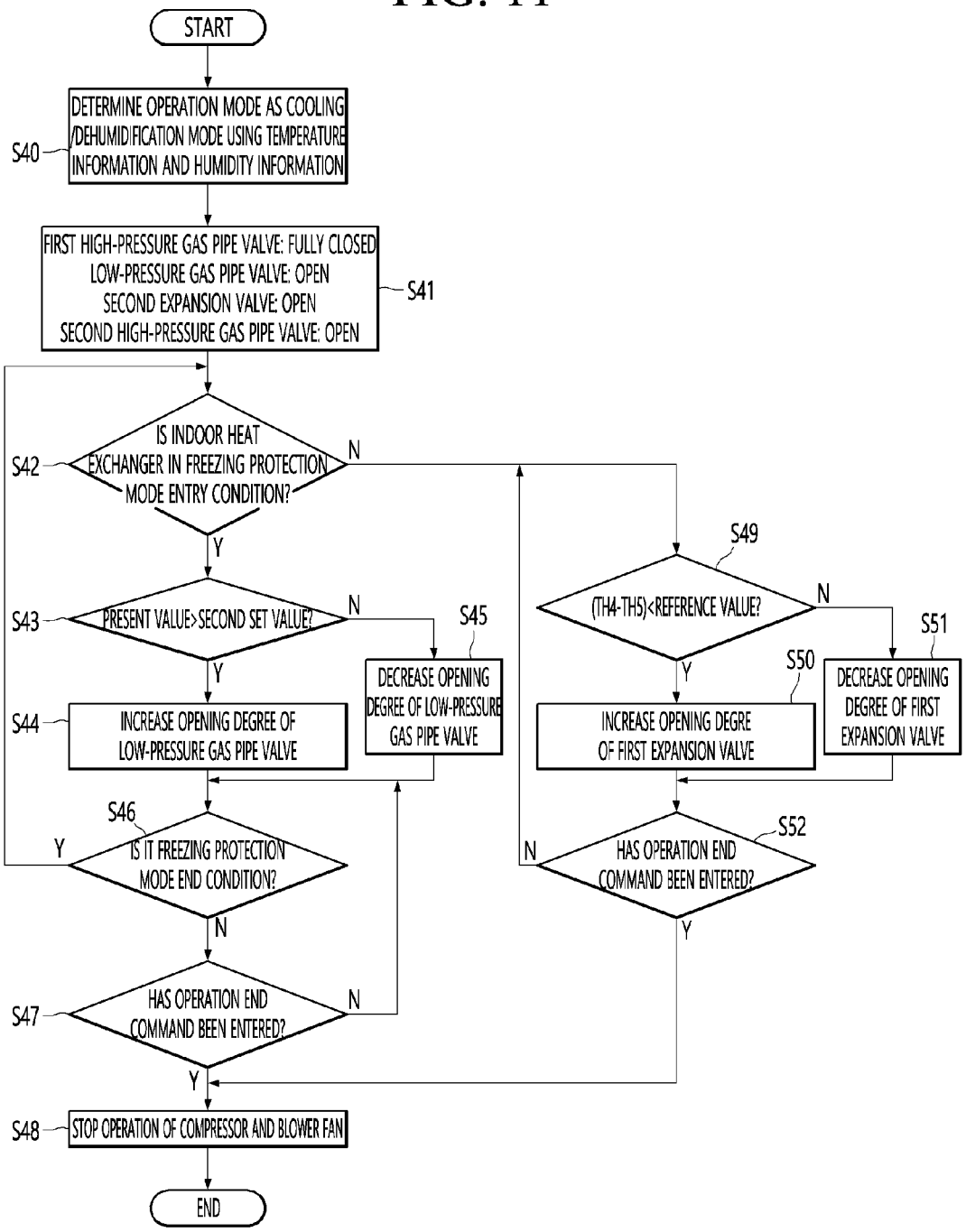
FIGS. 11 and 12 are flowcharts of a method for controlling an air conditioner in a cooling/dehumidifying mode of an indoor unit according to an embodiment.

FIG. 11 is a flowchart of a method for controlling an air conditioner in a cooling/dehumidifying mode of an indoor unit according to an embodiment. Hereinafter, the first cooling/dehumidifying mode in which the outdoor heat exchanger functions as a condenser will be exemplarily described.

Referring to FIG. 11, the air conditioner determines an operation mode as a cooling/dehumidifying mode M3 using temperature information and humidity information (S40). The temperature information may include a present temperature value of the outdoor air detected by the first temperature detection sensor T1 and a set or predetermined temperature value input by a user.

The humidity information may include a present humidity value of outdoor air detected by the humidity detection sensor HU, and a set or predetermined humidity value input by a user. For example, when the set temperature value input by the user is lower than the present temperature value of the outdoor air and the set humidity value input by the user is lower than the present humidity value of the outdoor air, the air conditioner may be operated in the cooling/dehumidifying mode M3.

When operating in the cooling/dehumidifying mode M3, the first high-pressure gas pipe valve 44 is closed, and the low-pressure gas pipe valve 54, the second expansion valve 38, and the second high-pressure gas pipe valve 48 all are opened (S41). Accordingly, the outdoor heat exchanger of the outdoor unit 1 functions as a condenser, the first heat exchanger 16 functions as an evaporator, and the second heat exchanger 18 functions as a condenser.

The air conditioner may prevent the indoor heat exchanger (dehumidification coil) from freezing by controlling the opening degree of the low-pressure gas pipe valve 54. That is, the air conditioner determines whether the indoor heat exchanger is in a freezing protection mode entry condition (S42).

More specifically, the freezing protection mode entry condition may include a case in which the inlet-side refrigerant temperature of the first heat exchanger 16 is less than a first set or predetermined value, the outlet-side refrigerant temperature of the first heat exchanger 16 is less than a first set or predetermined value, or the temperature of the air passing through the first heat exchanger 16 is less than a first set or predetermined value. The first set or predetermined value may be a preset or predetermined temperature and may be set by a user.

In other words, when the first temperature value, the second temperature value, the fourth temperature value, or the fifth temperature value is lower than the first set value, the air conditioner may enter the freezing protection mode. When the freezing protection mode is entered, the air conditioner determines whether the present value is greater than a second set or predetermined value (S43). The present value may be a temperature detected by the fourth temperature detection sensor T4 or a temperature detected by the fifth temperature detection sensor T5. Alternatively, the present value may be an average value of the fourth temperature value and the fifth temperature value. The second set value means a preset or predetermined temperature value (S43).

When the present value is greater than the second set value, the air conditioner determines that a possibility of freezing of the indoor heat exchanger is small, and thus, increases or maintains the opening degree of the low-pressure gas pipe valve 54 (S44). When the opening degree of the low-pressure gas pipe valve 54 increases, the flow rate of the refrigerant passing through the low-pressure gas pipe valve 54 increases, so that a cooling capacity of the indoor heat exchanger may be improved.

In contrast, when the present value is smaller than the second set value, the air conditioner determines that the possibility of freezing of the indoor heat exchanger is high, and reduces the opening degree of the low-pressure gas pipe valve 54 (S45). When the opening degree of the low-pressure gas pipe valve 54 is decreased, the pressure of the refrigerant passing through the low-pressure gas pipe valve 54 increases. In this case, the flow rate coefficient of the low-pressure gas pipe valve 54 may be greater than the flow rate coefficient of the first expansion valve 34 and the outdoor expansion valve of the outdoor unit 1. Accordingly, as the evaporation pressure (indoor evaporation pressure) of the indoor heat exchanger is controlled to be higher than the evaporation pressure (outdoor evaporation pressure) of the outdoor heat exchanger, freezing of the indoor heat exchanger may be prevented.

Thereafter, the air conditioner determines whether the freezing protection mode end condition is met (S46). If the freezing protection mode end condition is met, the air conditioner proceeds to S42, and if the freezing protection mode end condition is not met, the air conditioner determines whether an operation end command is input (S47).

More specifically, the freezing protection mode end condition may include a state in which the inlet-side refrigerant temperature of the first heat exchanger 16 is a third set or predetermined value or more, or the outlet-side refrigerant temperature of the first heat exchanger 16 is the third set value or more. The third set value may be a temperature higher than the first set value and the second set value. In other words, when the fourth temperature value or the fifth temperature value is higher than the third set value, the air conditioner may end the freezing protection mode.

The air conditioner stops operation of the compressor and the blower fan 14 when an operation end command is input (S48) and proceeds to S46 when the operation end command is not input.

When the air conditioner does not meet the freezing protection mode entry condition, it is possible to control the opening degree of the first expansion valve 34 to achieve an appropriate level of cooling. The air conditioner may determine whether the present cooling level of the indoor unit is a target level (set level). That is, the air conditioner determines whether a difference between the fourth temperature value TH4 and the fifth temperature value TH5 is smaller than a reference value (S49).

When the difference between the fourth temperature value and the fifth temperature value is smaller than the reference value, the air conditioner determines that the present cooling level of the indoor unit is less than the target level, and thus, increases the opening degree of the first expansion valve 34 (S50). When the opening degree of the first expansion valve 34 is increased, the flow rate of the refrigerant passing through the first expansion valve 34 further increases, so that the present cooling level of the indoor unit may increase close to the target level.

In contrast, when the difference between the fourth temperature value and the fifth temperature value is greater than the reference value, the air conditioner determines that the present cooling level of the indoor unit exceeds the target level, and thus, reduces the opening degree of the first expansion valve 34 (S51). When the opening degree of the first expansion valve 34 decreases, the flow rate of the refrigerant passing through the first expansion valve 34 relatively decreases, so that the present cooling level of the indoor unit may decrease close to the target level.

Thereafter, the air conditioner determines whether an operation end command is input (S52), stops operation of the compressor and the blower fan 14 when the operation end command is input (S48), and proceeds to S49 when the operation end command is not input.

According to the cooling/dehumidifying mode M3 as described above, it is possible to prevent the indoor heat exchanger (dehumidification coil) from freezing when operated for a long time in the cooling/dehumidifying mode. In other words, in the cooling/dehumidifying mode M3, by adjusting the opening degree of the low-pressure gas pipe valve 54, the indoor evaporation pressure is controlled to be higher than the outdoor evaporation pressure, thereby preventing the indoor heat exchanger from freezing.

Figure 12:
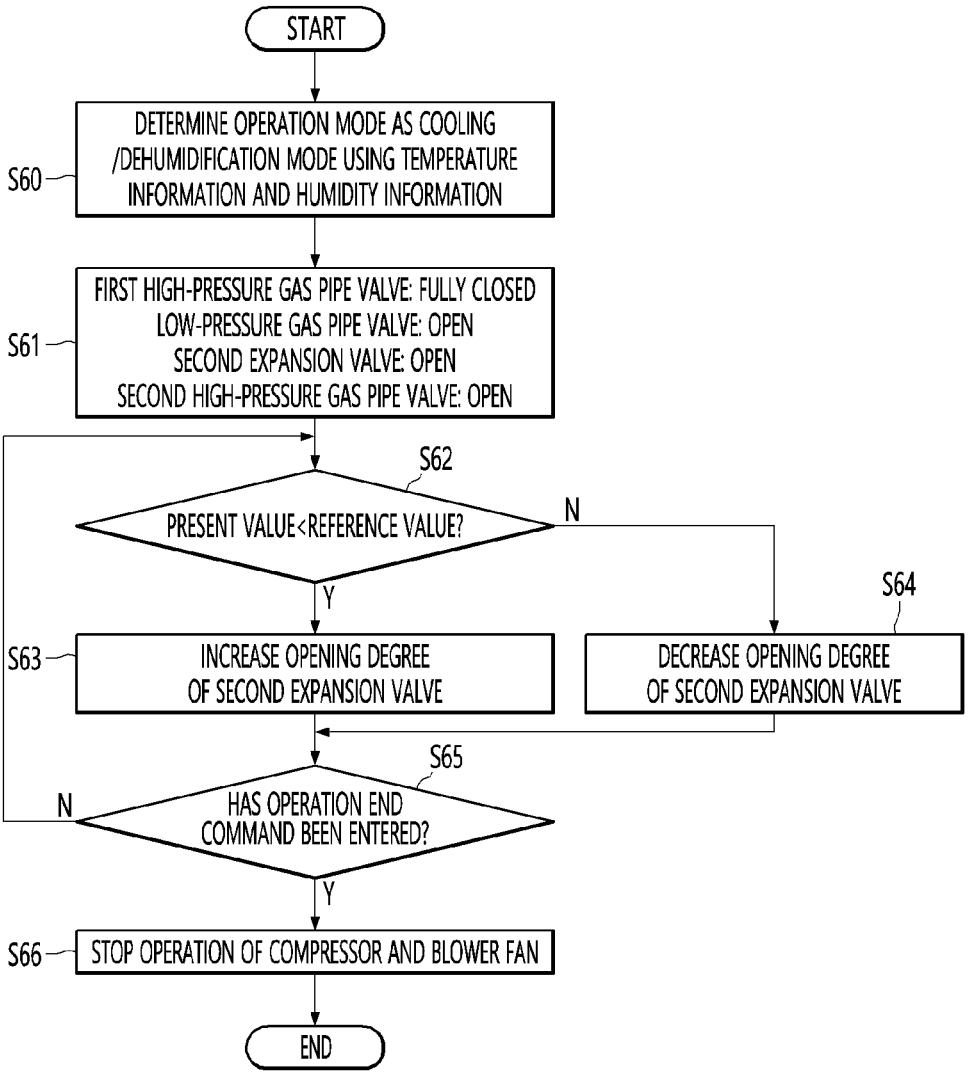

FIG. 12 is flowchart of a method for controlling an air conditioner in a cooling/dehumidifying mode of an indoor unit according to an embodiment. FIG. 12 illustrates a method for controlling the opening degree of the second expansion valve 38 in the cooling/dehumidifying mode M3.

Referring to FIG. 12, the air conditioner determines an operation mode as a cooling/dehumidifying mode using temperature information and humidity information (S60). When operating in the cooling/dehumidifying mode M3, the first high-pressure gas pipe valve 44 is closed, and the low-pressure gas pipe valve 54, the second expansion valve 38, and the second high-pressure gas pipe valve 48 all are opened (S61).

The air conditioner may control the opening degree of the second expansion valve 38 to achieve an appropriate level of cooling. The air conditioner may determine whether the present cooling level of the indoor unit is a target level (set level). That is, the air conditioner determines whether the present value is smaller than a reference value (target value) (S62). The present value means the temperature detected by the third temperature detection sensor T3, and the reference value means a preset or predetermined temperature value.

When the present value is smaller than the reference value, the air conditioner determines that the present cooling level of the indoor unit is less than the target level, and thus, increases the opening degree of the second expansion valve 38 (S63). When the opening degree of the second expansion valve 38 increases, the flow rate of the refrigerant passing through the second expansion valve 38 further increases, so that the present cooling level of the indoor unit may increase close to the target level.

In contrast, when the present value is greater than the reference value, the air conditioner determines that the present cooling level of the indoor unit exceeds the target level, and thus, reduces the opening degree of the second expansion valve 38 (S64). When the opening degree of the second expansion valve 38 is decreased, the flow rate of the refrigerant passing through the second expansion valve 38 relatively decreases, so that the present cooling level of the indoor unit may decrease close to the target level.

The air conditioner determines whether an operation end command is input through the input portion (S65), stops operation of the compressor and the blower fan 14 when the operation end command is input (S66), and when the operation end command is not input, proceeds to S62.

Figure 13:
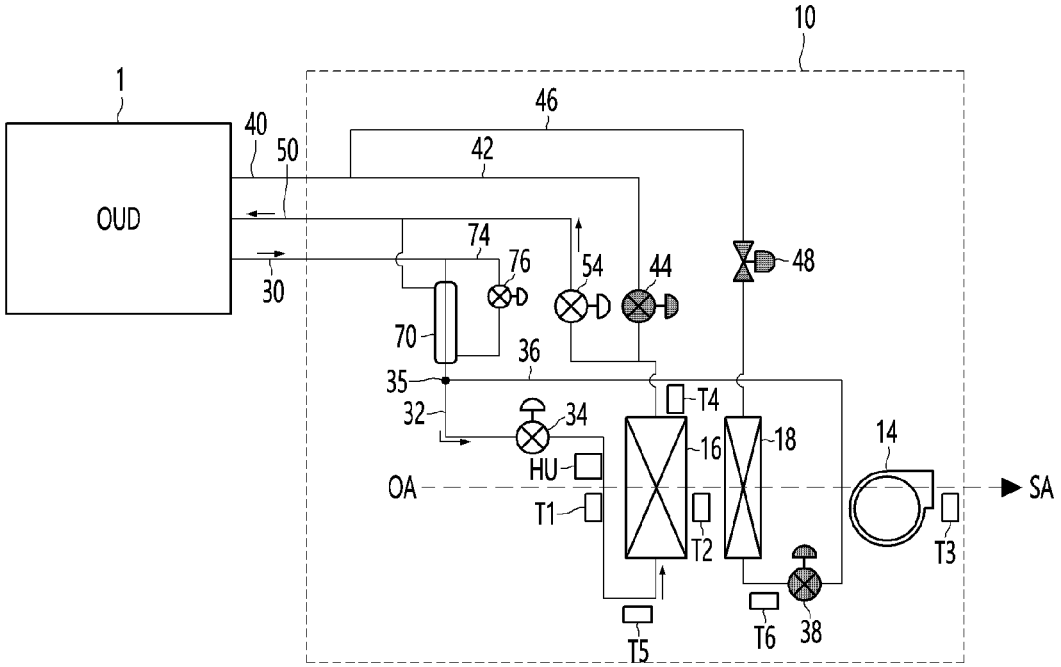
FIG. 13 is a piping diagram for explaining refrigerant flow in a defrost mode according to an embodiment.

FIG. 13 is a piping diagram for explaining refrigerant flow in a defrost mode according to an embodiment. Hereinafter, the defrost mode M4 will be described with reference to FIG. 13.

The defrost mode M4 is a mode used for a predetermined period of time to defrost the outdoor heat exchanger of the outdoor unit while the air conditioner is operating in the heating mode M1. The defrost mode M4 may be similar to the refrigerant flow in the cooling mode M1 described above.

The defrost mode M4 may significantly increase the frequency of the compressor in order to increase a defrosting capability of the outdoor heat exchanger. This defrost mode M4 may be used for an oil recovery operation for oil recovery of the compressor.

In the defrost mode M4, only the liquid pipe 30 and the low-pressure gas pipe 50 are used, and the refrigerant may not flow into the high-pressure gas pipe 40. In the defrost mode M4, the refrigerant is introduced into the indoor unit 10 from the outdoor unit 1 through the liquid pipe 30, and the refrigerant of the indoor unit 10 is introduced into the outdoor unit 1 through the low-pressure gas pipe 50.

At this time, the low-pressure gas pipe valve 54, the first expansion valve 34, and the supercooling expansion valve 76 are opened, and the first high-pressure gas pipe valve 44, the second high-pressure gas pipe valve 48, and the second expansion valve 38 are closed. The outdoor heat exchanger of the outdoor unit 1 functions as a condenser, and the first heat exchanger 16 functions as an evaporator. In addition, the refrigerant does not flow to the second heat exchanger 18.

When the air conditioner is operated in the defrost mode M4, the compressor of the outdoor unit 1 is driven with a large increase in frequency. The high-temperature and high-pressure refrigerant compressed by the compressor is condensed in the outdoor heat exchanger of the outdoor unit 1 and then is introduced into the indoor unit 10 through the liquid pipe 30. In this process, a surface temperature of the outdoor heat exchanger may increase while high-temperature and high-pressure gaseous refrigerant flows through the outdoor heat exchanger.

A (first) portion of the refrigerant in the liquid pipe 30 is introduced into the supercooling expansion valve 76 through the branch pipe 74, and the other (second) portion of the refrigerant is introduced into the first expansion valve 34 through the first liquid pipe 32. The refrigerant that has passed through the first expansion valve 34 is reduced in pressure and then is introduced into the first heat exchanger 16 and evaporates. The refrigerant discharged from the first heat exchanger 16 passes through the low-pressure gas pipe valve 54 along the low-pressure gas pipe 50. At this time, the low-pressure gas pipe valve 54 may be in a fully open state or a partially open state. The refrigerant that has passed through the low-pressure gas pipe valve 54 is introduced into the compressor of the outdoor unit 1 along the low-pressure gas pipe 50.

Figure 14:
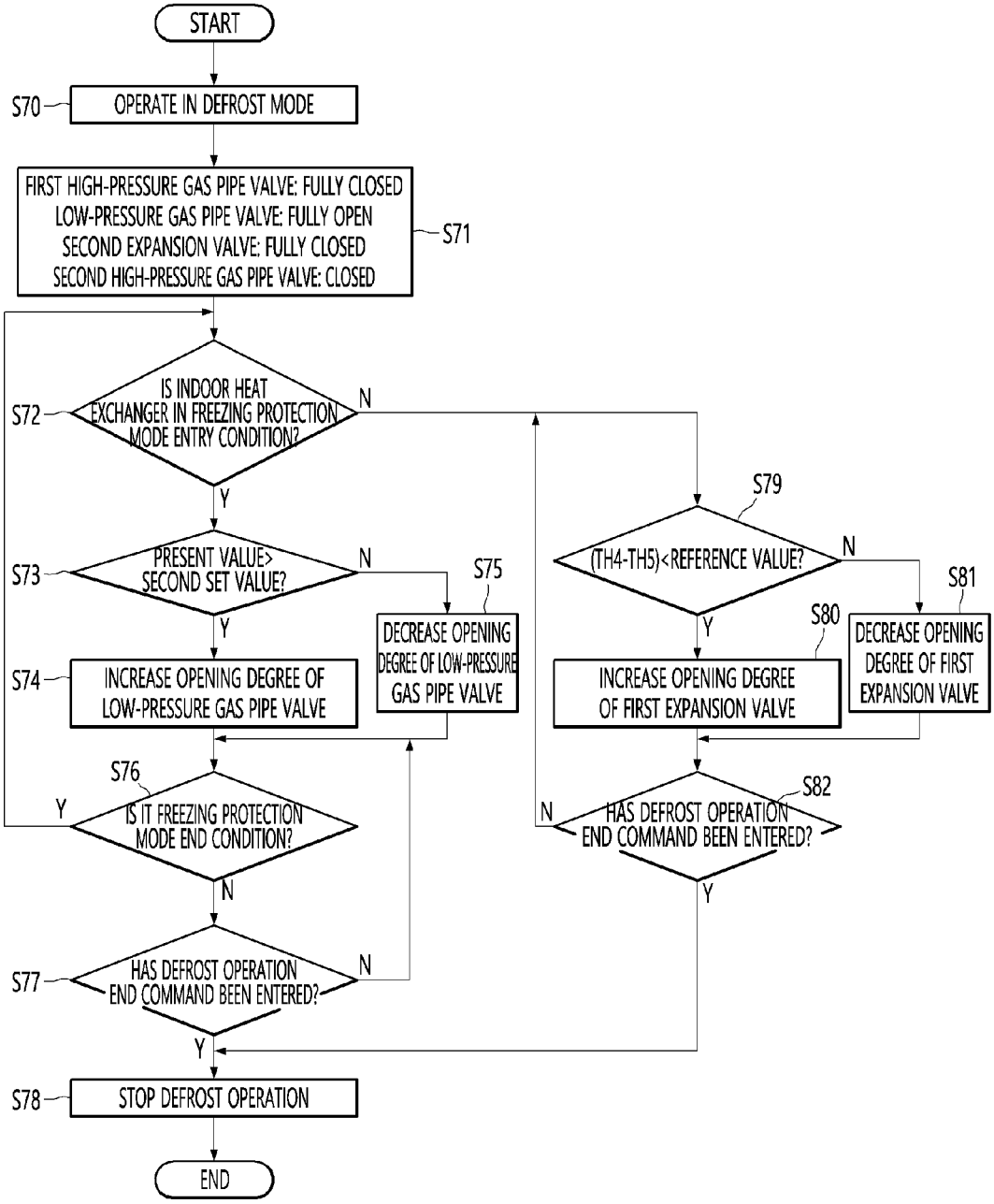
FIG. 14 is a flowchart of a method for controlling an air conditioner in a defrost mode according to an embodiment.

FIG. 14 is a flowchart of a method for controlling an air conditioner in a defrost mode according to an embodiment. Referring to FIG. 14, the air conditioner may be operated in a defrost mode M4 (S70). The defrost mode may be understood as an operation mode for preventing the outdoor heat exchanger from freezing while operating in the heating mode.

The defrost mode may be performed by a user input or may be performed under a set or predetermined defrost operation condition. For example, the air conditioner may perform a defrost operation according to a temperature detected by a temperature sensor installed in an outdoor heat exchanger of the outdoor unit.

When operating in the defrost mode M4, the first high-pressure gas pipe valve 44 is closed, the low-pressure gas pipe valve 54 is opened, and the second expansion valve 38 and the second high-pressure gas pipe valve 48 are closed (S71). Accordingly, the outdoor heat exchanger of the outdoor unit 1 functions as a condenser, and the first heat exchanger 16 functions as an evaporator. The second heat exchanger 18 is not used.

While the air conditioner is operated in the defrost mode M4, it is possible to prevent the indoor heat exchanger from freezing by controlling the opening degree of the low-pressure gas pipe valve 54. That is, the air conditioner determines whether the indoor heat exchanger is in the freezing protection mode entry condition (S72).

More specifically, the freezing protection mode entry condition may include a case in which the inlet-side refrigerant temperature of the first heat exchanger 16 is less than a first set or predetermined value, the outlet-side refrigerant temperature of the first heat exchanger 16 is less than a first set or predetermined value, or the temperature of the air passing through the first heat exchanger 16 is less than a first set or predetermined value. The first set or predetermined value may be a preset or predetermined temperature and may be set by a user.

In other words, when the first temperature value, the second temperature value, the fourth temperature value, or the fifth temperature value is lower than the first set value, the air conditioner may enter the freezing protection mode. When the freezing protection mode is entered, the air conditioner determines whether the present value is greater than a second set or predetermined value (S73). The present value may be a temperature detected by the fourth temperature detection sensor T4 or a temperature detected by the fifth temperature detection sensor T5. Alternatively, the present value may be an average value of the fourth temperature value and the fifth temperature value. The second set value means a preset or predetermined temperature value.

When the present value is greater than the second set value, the air conditioner determines that a possibility of freezing of the indoor heat exchanger is small, and increases or maintains the opening degree of the low-pressure gas pipe valve 54 (S74). When the opening degree of the low-pressure gas pipe valve 54 increases, the flow rate of the refrigerant passing through the low-pressure gas pipe valve 54 increases, so that the cooling capacity of the indoor heat exchanger may be improved.

In contrast, when the present value is smaller than the second set value, the air conditioner determines that the possibility of freezing of the indoor heat exchanger is high, and reduces the opening degree of the low-pressure gas pipe valve 54 (S75). When the opening degree of the low-pressure gas pipe valve 54 is decreased, the pressure of the refrigerant passing through the low-pressure gas pipe valve 54 increases. In this case, the flow rate coefficient of the low-pressure gas pipe valve 54 may be greater than the flow rate coefficient of the first expansion valve 34 and the outdoor expansion valve of the outdoor unit. Accordingly, as the evaporation pressure of the indoor heat exchanger is controlled to be higher than the evaporation pressure of the outdoor heat exchanger, freezing of the indoor heat exchanger may be prevented.

Thereafter, the air conditioner determines whether the freezing protection mode end condition is met (S76). If the freezing protection mode end condition is met, the air conditioner proceeds to S72, and if the freezing protection mode end condition is not met, the air conditioner determines whether the defrost operation end command is input (S77).

More specifically, the freezing protection mode end condition may include a case in which the inlet-side refrigerant temperature of the first heat exchanger 16 is a third set or predetermined value or more, or the outlet-side refrigerant temperature of the first heat exchanger 16 is the third set value or more. The third set or predetermined value may be a temperature higher than the first set value and the second set value. In other words, when the fourth temperature value or the fifth temperature value is higher than the third set value, the air conditioner may end the freezing protection mode.

When the defrost operation end command is input, the air conditioner may end the defrost operation and switch to a heating mode (S78). When the air conditioner does not meet the freezing protection mode entry condition, it is possible to control the opening degree of the first expansion valve 34 to achieve an appropriate level of cooling. The air conditioner may determine whether the present cooling level of the indoor unit is a target level (set level). That is, the air conditioner determines whether a difference between the fourth temperature value TH4 and the fifth temperature value TH5 is smaller than a reference value (S79). The fourth temperature value TH4 means the temperature detected by the fourth temperature detection sensor T4, and the fifth temperature value TH5 means the temperature detected by the fifth temperature detection sensor T5, and the reference value means a preset or predetermined temperature value.

When the difference between the fourth temperature value and the fifth temperature value is smaller than the reference value, the air conditioner determines that the present cooling level of the indoor unit is less than the target level and increases the opening degree of the first expansion valve 34

(S80). When the opening degree of the first expansion valve 34 increases, the flow rate of the refrigerant passing through the first expansion valve 34 further increases, so that the present cooling level of the indoor unit may increase close to the target level.

In contrast, when the difference between the fourth temperature value and the fifth temperature value is greater than the reference value, the air conditioner determines that the present cooling level of the indoor unit exceeds the target level, and thus, reduces the opening degree of the first expansion valve 34 (S81). When the opening degree of the first expansion valve 34 decreases, the flow rate of the refrigerant passing through the first expansion valve 34 relatively decreases, so that the present cooling level of the indoor unit may decrease close to the target level.

Thereafter, the air conditioner determines whether a defrost operation end command is input (S82), ends the defrost operation when the defrost operation end command is input (S78), and proceeds to S79 when the defrost operation end command is not input.

According to the defrost mode M4 as described above, it is possible to prevent the outdoor heat exchanger from freezing when operating in the heating mode for a long time. More specifically, when the compressor frequency increases in order to increase the defrosting ability of the outdoor heat exchanger while operating in the defrost mode M4, the evaporation pressure of the indoor heat exchanger may decrease, thereby causing freezing in the indoor heat exchanger. Therefore, in embodiments disclosed herein, the indoor heat exchanger may be prevented from freezing by controlling the opening degree of the low-pressure gas pipe valve 54 in the defrost mode M4 to control the indoor evaporation pressure to be higher than the outdoor evaporation pressure.

With an air conditioner according to embodiments disclosed herein having the configuration as described above, at least the following advantages are obtained.

First, it is possible to prevent freezing from occurring in the dehumidification coil that performs cooling or cooling/dehumidification by introducing outside air. More specifically, by controlling the opening degree of the low-pressure gas pipe valve based on the temperature of the refrigerant flowing through the dehumidification coil, the indoor evaporation pressure may be made higher than the outdoor evaporation pressure, thereby preventing freezing of the dehumidification coil in advance.

Second, as the pressure of the dehumidification coil and the temperature of the surface are controlled through the control of the opening degree of the valve, a separate operation is not required to prevent freezing. Thus, it has the advantage of contributing to the increase of the continuous operation time of the air conditioner.

Third, as the opening degree of the electronic expansion valve is precisely controlled using the refrigerant temperature of the dehumidification coil, there is an advantage in that it is possible to secure sufficient cooling and dehumidification performance as well as prevent freezing of the dehumidification coil.

Fourth, as freezing of the dehumidification coil is prevented by a simple structure and algorithm without adding additional components, product cost is low and maintenance and repair are easy.

Embodiments disclosed herein have been proposed to improve the above problems, and to provide an air conditioner capable of preventing a dehumidification coil from freezing.

Embodiments disclosed herein provide an air conditioner in which temperature adjustment and humidity adjustment of air supplied to a room may be easily performed through a plurality of heat exchangers. Embodiments disclosed herein further provide an air conditioner capable of contributing to securing sufficient dehumidification performance and increasing continuous operation time without separate operation for preventing freezing of the dehumidification coil. Embodiments disclosed herein furthermore provide an air conditioner capable of preventing the dehumidification coil from freezing by controlling the indoor evaporation pressure to be higher than the outdoor evaporation pressure.

Embodiments disclosed herein provide an air conditioner capable of controlling the pressure of the dehumidification coil and the temperature of the surface by adjusting the opening degree of the expansion valve. Embodiments disclosed herein also provide an air conditioner capable of preventing frost from forming on the dehumidification coil by adjusting the opening degree of the expansion valve based on the temperature of the refrigerant flowing through the dehumidification coil.

An air conditioner according to embodiments disclosed herein may include a case in which an air flow path through which outdoor air is flowing into an indoor is formed; a first heat exchanger disposed on the air flow path, through which the refrigerant flows, and exchanges heat between the flowing air and the refrigerant; a second heat exchanger disposed downstream of the first heat exchanger on the air flow path, through which a refrigerant selectively flows, and exchanging heat between the flowing air and the refrigerant; a liquid pipe connected to each of the first heat exchanger and the second heat exchanger, through which a liquid refrigerant flows; a high-pressure gas pipe connected to each of the first heat exchanger and the second heat exchanger, through which gaseous refrigerant flows; a low-pressure gas pipe through which gaseous refrigerant discharged from the first heat exchanger and the second heat exchanger flows; a high-pressure gas pipe valve installed in the high-pressure gas pipe; a low-pressure gas pipe valve installed in the low-pressure gas pipe; an expansion valve installed in the liquid pipe; and a controller configured to control an opening degree of the low-pressure gas pipe valve, based on a temperature of the refrigerant flowing through the first heat exchanger. With this configuration, by controlling the opening degree of the low-pressure gas pipe valve based on the refrigerant temperature of the dehumidifying coil, the indoor evaporation pressure may be made higher than the outdoor evaporation pressure, thereby preventing freezing of the heat exchanger.

The controller may be configured to control the opening degree of the low-pressure gas pipe valve, based on an inlet-side refrigerant temperature or an outlet-side refrigerant temperature of the first heat exchanger.

The controller may be configured to determine whether the inlet-side refrigerant temperature of the first heat exchanger is less than a set or predetermined value, and decrease the opening degree of the low-pressure gas pipe valve when the inlet-side refrigerant temperature of the first heat exchanger is less than a set or predetermined value.

The controller may be configured to increase or maintain the opening degree of the low-pressure gas pipe valve when the inlet-side refrigerant temperature of the first heat exchanger is a set or predetermined value or more. The controller may be configured to determine whether the outlet-side refrigerant temperature of the first heat exchanger is less than a set or predetermined value, and decrease the opening degree of the low-pressure gas pipe valve when the refrigerant temperature at the outlet-side refrigerant temperature of the first heat exchanger is less than a set or predetermined value.

The controller may be configured to increase or maintain the opening degree of the low-pressure gas pipe valve when the outlet-side refrigerant temperature of the first heat exchanger is a set or predetermined value or more. The controller may be configured to determine whether the first heat exchanger is in a freezing protection mode entry condition, and control the opening degree of the low-pressure gas pipe valve, based on a temperature of the refrigerant flowing through the first heat exchanger when a freezing protection mode entry condition are met.

The freezing protection mode entry condition may include a case where the inlet-side refrigerant temperature of the first heat exchanger is less than the first set value, or a case where the outlet-side refrigerant temperature of the first heat exchanger is less than the first set value.

The controller may be configured to determine whether the inlet-side refrigerant temperature of the first heat exchanger is less than a second set or predetermined value, that is, smaller than the first set value when the freezing protection mode entry condition is met, and decrease the opening degree of the low-pressure gas pipe valve when the inlet-side refrigerant temperature of the first heat exchanger is less than the second set value. The controller may be configured to increase or maintain the opening degree of the low-pressure gas pipe valve when the inlet-side refrigerant temperature of the first heat exchanger is the second set value or more.

The controller may be configured to determine whether the outlet-side refrigerant temperature of the first heat exchanger is less than a second set or predetermined value, that is, smaller than the first set value, if the freezing protection mode entry condition is met, and decrease the opening degree of the low-pressure gas pipe valve when the outlet-side refrigerant temperature of the first heat exchanger is less than the second set value. The controller may be configured to increase or maintain the opening degree of the low-pressure gas pipe valve when the outlet-side refrigerant temperature of the first heat exchanger is the second set value or more.

The freezing protection mode entry condition may include a case where the temperature of the air passing through the first heat exchanger is less than a first set value. The controller may be configured to determine whether a difference between the inlet-side refrigerant temperature and the outlet-side refrigerant temperature of the first heat exchanger is less than a reference value if the freezing protection mode entry condition is not met, and increase an opening degree of the expansion valve when a difference between the inlet-side refrigerant temperature and the outlet-side refrigerant temperature of the first heat exchanger is less than a reference value.

The controller may be configured to decrease the opening degree of the expansion valve when a difference between an inlet-side refrigerant temperature and an outlet-side refrigerant temperature of the first heat exchanger is a reference value or more. The controller may be configured to control the opening degree of the low-pressure gas pipe valve in a cooling mode or a cooling/dehumidifying mode of the air conditioner.

In the cooling mode, the first heat exchanger functions as an evaporator, and the refrigerant does not flow through the second heat exchanger. In the cooling/dehumidifying mode, the first heat exchanger functions as an evaporator, and the second heat exchanger functions as a condenser.

The low-pressure gas pipe valve may include an electronic expansion valve (EEV) that adjusts a pressure of the refrigerant passing through the opening degree control, and a flow rate coefficient of the low-pressure gas pipe valve may be greater than a flow rate coefficient of the expansion valve.

The air conditioner may further include an outdoor unit having a compressor configured to compress the refrigerant, an outdoor heat exchanger configured to exchange heat between the refrigerant and outdoor air, and an outdoor expansion valve configured to expand the refrigerant, in which a flow rate coefficient of the low-pressure gas pipe valve may be greater than a flow rate coefficient of the outdoor expansion valve.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a case in which an air flow path through which outdoor air flows into an indoor space is formed;

a first heat exchanger disposed in the air flow path and that exchanges heat between the air and a refrigerant;

a second heat exchanger disposed downstream of the first heat exchanger in the air flow path, through which the refrigerant selectively flows, and that exchanges heat between the air and the refrigerant;

a liquid pipe connected to each of the first heat exchanger and the second heat exchanger, through which liquid refrigerant flows;

a high-pressure gas pipe connected to each of the first heat exchanger and the second heat exchanger, through which gaseous refrigerant flows;

a low-pressure gas pipe through which the gaseous refrigerant discharged from the first heat exchanger and the second heat exchanger flows;

a high-pressure gas pipe valve installed in the high-pressure gas pipe;

a low-pressure gas pipe valve installed in the low-pressure gas pipe;

an expansion valve installed in the liquid pipe; and a controller configured to control an opening degree of the low-pressure gas pipe valve based on a temperature of the refrigerant flowing through the first heat exchanger.

2. The air conditioner of claim 1, wherein the controller is configured to:

control the opening degree of the low-pressure gas pipe valve based on an inlet-side refrigerant temperature or an outlet-side refrigerant temperature of the first heat exchanger.

3. The air conditioner of claim 2, wherein the controller is configured to:

determine whether the inlet-side refrigerant temperature of the first heat exchanger is less than a predetermined value, and decrease the opening degree of the low-pressure gas pipe valve when the inlet-side refrigerant temperature of the first heat exchanger is less than the predetermined value.

4. The air conditioner of claim 3, wherein the controller is configured to:

increase or maintain the opening degree of the low-pressure gas pipe valve when the inlet-side refrigerant temperature of the first heat exchanger is the predetermined value or more.

5. The air conditioner of claim 2, wherein the controller is configured to:

determine whether the outlet-side refrigerant temperature of the first heat exchanger is less than a predetermined value, and decrease the opening degree of the low-pressure gas pipe valve when the refrigerant temperature at the outlet-side refrigerant temperature of the first heat exchanger is less than the predetermined value.

6. The air conditioner of claim 5, wherein the controller is configured to:

increase or maintain the opening degree of the low-pressure gas pipe valve when the outlet-side refrigerant temperature of the first heat exchanger is the predetermined value or more.

7. The air conditioner of claim 1, wherein the controller is configured to:

determine whether the first heat exchanger is in a freezing protection mode entry condition, and control the opening degree of the low-pressure gas pipe valve based on a temperature of the refrigerant flowing through the first heat exchanger when the freezing protection mode entry condition is met.

8. The air conditioner of claim 7, wherein the freezing protection mode entry condition includes:

a case in which an inlet-side refrigerant temperature of the first heat exchanger is less than a first predetermined value, or a case in which an outlet-side refrigerant temperature of the first heat exchanger is less than the first predetermined value.

9. The air conditioner of claim 8, wherein the controller is configured to:

determine whether the inlet-side refrigerant temperature of the first heat exchanger is less than a second predetermined value which is smaller than the first predetermined value when the freezing protection mode entry condition is met, and decrease the opening degree of the low-pressure gas pipe valve when the inlet-side refrigerant temperature of the first heat exchanger is less than the second predetermined value.

10. The air conditioner of claim 9, wherein the controller is configured to:

increase or maintain the opening degree of the low-pressure gas pipe valve when the inlet-side refrigerant temperature of the first heat exchanger is the second predetermined value or more.

11. The air conditioner of claim 8, wherein the controller is configured to:

determine whether the outlet-side refrigerant temperature of the first heat exchanger is less than a second predetermined value which is smaller than the first predetermined value when the freezing protection mode entry condition is met, and decrease the opening degree of the low-pressure gas pipe valve when the outlet-side refrigerant temperature of the first heat exchanger is less than the second predetermined value.

12. The air conditioner of claim 11, wherein the controller is configured to:

increase or maintain the opening degree of the low-pressure gas pipe valve when the outlet-side refrigerant temperature of the first heat exchanger is the second predetermined value or more.

13. The air conditioner of claim 7, wherein the freezing protection mode entry condition includes:

a case in which a temperature of air passing through the first heat exchanger is less than a first predetermined value.

14. The air conditioner of claim 7, wherein the controller is configured to:

determine whether a difference between an inlet-side refrigerant temperature and an outlet-side refrigerant temperature of the first heat exchanger is less than a reference value when the freezing protection mode entry condition is not met, and increase an opening degree of the expansion valve when the difference between the inlet-side refrigerant temperature and the outlet-side refrigerant temperature of the first heat exchanger is less than the reference value.

15. The air conditioner of claim 14, wherein the controller is configured to:

decrease the opening degree of the expansion valve when the difference between the inlet-side refrigerant temperature and the outlet-side refrigerant temperature of the first heat exchanger is the reference value or more.

16. The air conditioner of claim 1, wherein the controller is configured to:

control the opening degree of the low-pressure gas pipe valve in a cooling mode or a cooling/dehumidifying mode of the air conditioner.

17. The air conditioner of claim 16, wherein, in the cooling mode, the first heat exchanger functions as an evaporator, and the refrigerant does not flow through the second heat exchanger.

18. The air conditioner of claim 16, wherein, in the cooling/dehumidifying mode, the first heat exchanger functions as an evaporator, and the second heat exchanger functions as a condenser.

19. The air conditioner of claim 1, wherein the low-pressure gas pipe valve includes an electronic expansion valve (EEV) that adjusts a pressure of refrigerant passing by controlling the opening degree, and wherein a flow rate coefficient of the low-pressure gas pipe valve is greater than a flow rate coefficient of the expansion valve.

20. An air conditioner, comprising:

a case into which outdoor air flows;

a first heat exchanger disposed in the air flow that exchanges heat between the air and a refrigerant;

a second heat exchanger, through which the refrigerant selectively flows, and that exchanges heat between the air and the refrigerant;

a liquid pipe connected to each of the first heat exchanger and the second heat exchanger, through which liquid refrigerant flows;

a high-pressure gas pipe connected to each of the first heat exchanger and the second heat exchanger, through which gaseous refrigerant flows;

a low-pressure gas pipe through which the gaseous refrigerant discharged from the first heat exchanger and the second heat exchanger flows;

a high-pressure gas pipe valve installed in the high-pressure gas pipe;

a low-pressure gas pipe valve installed in the low-pressure gas pipe;

an expansion valve installed in the liquid pipe; and a controller configured to control an opening degree of the low-pressure gas pipe valve based on a temperature of the refrigerant flowing through the first heat exchanger, wherein the low-pressure gas pipe valve adjusts a pressure of refrigerant passing by controlling the opening degree, and wherein a flow rate coefficient of the low-pressure gas pipe valve is greater than a flow rate coefficient of the expansion valve.

* * * * *